US008550556B2

(12) United States Patent
Asbach

(10) Patent No.: US 8,550,556 B2
(45) Date of Patent: Oct. 8, 2013

(54) RECONFIGURABLE INFANT SUPPORT STRUCTURE

(75) Inventor: Ronald Asbach, Grand Island, NY (US)

(73) Assignee: Mattel, Inc., El Segundo, CA (US)

( * ) Notice: Subject to any disclaimer, the term of this patent is extended or adjusted under 35 U.S.C. 154(b) by 179 days.

(21) Appl. No.: 13/038,756

(22) Filed: Mar. 2, 2011

(65) Prior Publication Data

US 2011/0227375 A1 Sep. 22, 2011

Related U.S. Application Data

(60) Provisional application No. 61/314,769, filed on Mar. 17, 2010.

(51) Int. Cl.
*A47D 13/10* (2006.01)
*A63G 9/00* (2006.01)

(52) U.S. Cl.
USPC ..... 297/281; 297/273

(58) Field of Classification Search
USPC ..... 297/273, 276, 277, 278, 279, 280, 281, 297/282
See application file for complete search history.

(56) References Cited

U.S. PATENT DOCUMENTS

| | | | |
|---|---|---|---|
| 223,109 | A | 12/1879 | Brick |
| 318,131 | A | 5/1885 | Paine |
| 342,855 | A | 6/1886 | Abbey et al. |
| 382,687 | A | 5/1888 | Burlin |
| 2,552,720 | A | 5/1951 | Keough |
| 2,779,389 | A | 1/1957 | Pearl |
| 3,269,771 | A | 8/1966 | Erdos |
| 3,869,170 | A | 3/1975 | James et al. |
| D254,942 | S | 5/1980 | Browning |
| 4,271,627 | A | 6/1981 | Echterling |
| 4,697,845 | A | 10/1987 | Kamman |
| 4,722,570 | A | 2/1988 | Bertoli |
| 5,238,291 | A | 8/1993 | Alionis |
| 5,334,099 | A | 8/1994 | Marra et al. |
| 5,413,399 | A | 5/1995 | Myers et al. |
| 5,445,432 | A | 8/1995 | Chien |
| 5,489,138 | A | 2/1996 | Mariol et al. |
| 5,507,550 | A | 4/1996 | Maloney |
| 5,533,786 | A | 7/1996 | Cone, II |
| 5,758,544 | A | 6/1998 | Lee |
| 5,791,999 | A | 8/1998 | Lauro et al. |
| 5,803,817 | A | 9/1998 | Stern |

(Continued)

FOREIGN PATENT DOCUMENTS

| | | | |
|---|---|---|---|
| EP | 1614371 | A1 | 1/2006 |
| EP | 1679105 | A1 | 7/2006 |
| GB | 2139881 | A | 11/1984 |
| GB | 2343623 | A | 5/2000 |

*Primary Examiner* — Rodney B White
(74) *Attorney, Agent, or Firm* — Edell, Shapiro & Finnan LLC

(57) ABSTRACT

A reconfigurable infant support structure includes a frame, a hanger arm movably coupled to the frame, and a seat movably coupled to the hanger arm. The hanger arm is placeable in a moving position and in a fixed position. The seat is positionable in a lowered position and in a raised position relative to the frame along the hanger arm. The seat is releasably securable in its raised position. The frame restricts the seat from being releasably secured in its raised position unless the hanger arm is in its fixed position. Conversely, the hanger arm can not be released from its fixed position unless the seat is in it lowered position.

23 Claims, 20 Drawing Sheets

(56) References Cited

U.S. PATENT DOCUMENTS

| | | | | |
|---|---|---|---|---|
| 5,806,922 | A | 9/1998 | Mendelovich | |
| 5,810,432 | A | 9/1998 | Haut et al. | |
| 6,010,410 | A | 1/2000 | Lauro et al. | |
| 6,024,412 | A | 2/2000 | Kain et al. | |
| 6,027,409 | A | 2/2000 | Favorito et al. | |
| 6,050,643 | A | 4/2000 | Kain et al. | |
| 6,161,898 | A | 12/2000 | Brevi | |
| 6,251,023 | B1 | 6/2001 | Lauro et al. | |
| 6,293,623 | B1 | 9/2001 | Kain et al. | |
| 6,347,833 | B1 | 2/2002 | Chen | |
| D454,007 | S | 3/2002 | Huang | |
| D456,189 | S | 4/2002 | Flannery et al. | |
| 6,421,901 | B2 | 7/2002 | Sitarski et al. | |
| 6,471,597 | B1 | 10/2002 | Flannery et al. | |
| 6,500,072 | B1 | 12/2002 | Myers et al. | |
| 6,511,123 | B1 | 1/2003 | Sitarski et al. | |
| 6,520,862 | B1 | 2/2003 | Armbruster et al. | |
| 6,544,128 | B1 | 4/2003 | Yang | |
| D477,719 | S | 7/2003 | Chaudeurge | |
| 6,666,505 | B2 | 12/2003 | Greger et al. | |
| 6,715,827 | B1 | 4/2004 | Chen | |
| 6,824,472 | B2 | 11/2004 | Armbruster et al. | |
| 6,857,966 | B2 | 2/2005 | Armbruster et al. | |
| 6,872,146 | B1 | 3/2005 | Paesang et al. | |
| 6,877,801 | B2 | 4/2005 | Asbach et al. | |
| 6,951,371 | B2 | 10/2005 | Wang | |
| 7,029,064 | B2 | 4/2006 | Chen | |
| D522,259 | S | 6/2006 | Wu | |
| 7,219,959 | B2 | 5/2007 | Ransil et al. | |
| 7,258,619 | B2 | 8/2007 | Tuckey | |
| 7,329,192 | B2 | 2/2008 | Gibree | |
| 7,354,352 | B2 | 4/2008 | Keska et al. | |
| 7,438,644 | B2 * | 10/2008 | Gubitosi et al. | 297/274 X |
| D579,673 | S | 11/2008 | Mancuso et al. | |
| 7,475,942 | B2 * | 1/2009 | Boyle et al. | 297/278 |
| 2002/0052245 | A1 | 5/2002 | Flannery et al. | |
| 2005/0110320 | A1 | 5/2005 | Wang | |
| 2006/0181123 | A1 | 8/2006 | Gibree | |
| 2007/0018490 | A1 | 1/2007 | Jones | |
| 2007/0069566 | A1 | 3/2007 | Li | |
| 2007/0194614 | A1 | 8/2007 | Chen et al. | |
| 2008/0020854 | A1 | 1/2008 | Tuckey et al. | |

* cited by examiner

RECONFIGURABLE INFANT SUPPORT STRUCTURE

CROSS-REFERENCE TO RELATED APPLICATION

This application claims the benefit of and priority under 35 U.S.C. 119(e) to U.S. Provisional Application No. 61/314,769, entitled "Reconfigurable Infant Support Structure", filed Mar. 17, 2010, the disclosure of which is incorporated herein by reference in its entirety.

FIELD OF THE INVENTION

The present invention relates to an infant support structure, and in particular, to an infant support structure that is reconfigurable between a swing mode and a highchair mode.

BACKGROUND OF THE INVENTION

Various infant support structures for supporting a child or infant are known in the art, such as swings, infant seats, and high chairs. Conventional support structures are typically relatively bulky and limited to a particular mode of operation. As a result, a parent or care giver often uses a separate swinging device and a separate highchair device. Some attempts have been made to provide a multi-mode device, such as for example the convertible swing and highchair disclosed in U.S. Pat. No. 6,511,123 to Sitarski et al., assigned to Mattel, Inc., the same assignee of the present application, and the disclosure of which is incorporated herein by reference. However, there is a need for a device which includes a modified and unique frame and movement configuration, as well as a mechanism for selectively obstructing or permitting reconfiguration between a swing mode and a highchair mode.

SUMMARY OF THE INVENTION

The present invention relates to a reconfigurable infant support structure including a frame configured to be supported by a support surface, an arm coupled to the frame, and a seat portion. The arm is placeable in a locked position in which the arm engages the frame and in a released position in which the arm moves relative to the frame. The seat portion is coupled to the arm and configured to support an infant. The seat portion is movable along the arm between a lowered position and a raised position. The seat portion is movable to its raised position when the arm is in its locked position.

In one embodiment, the seat portion is fixed relative to the frame in its raised position. The seat portion is restricted from being secured in its raised position when the arm is in its released position.

In one embodiment, the frame includes a hub. The arm is coupled to the hub. Movement of the seat portion is obstructed by the hub when the seat portion is moved along the arm toward its raised position when the arm is in its released position. In one implementation, the hub includes an engagement member, and the seat portion includes a receiving area configured to receive the engagement member when the arm is in its locked position.

In one embodiment, the arm is pivotally coupled to the frame. The seat portion is movable in a swinging motion relative to the frame when the arm is in its released position.

In one embodiment, the arm includes a first end portion pivotally coupled to the frame and an opposite second end portion. The second end portion includes a locking mechanism movable between a latched position engaging a portion of the frame and an unlatched position when the arm is in its released position.

The present invention also relates to a reconfigurable infant support structure including a frame, a hanger arm movably coupled to the frame, and a seat movably coupled to the hanger arm. The hanger arm is placeable in a moving position and in a fixed position. The seat is positionable in a lowered position and in a raised position relative to the frame along the hanger arm. The seat is releasably securable in its raised position. The frame restricts the seat from being releasably secured in its raised position unless the hanger arm is in its fixed position.

In one embodiment, the frame includes a hub to which the hanger arm is movably coupled. The seat includes a receiving area configured to receive the hub. The hub is receiveable in the receiving area when the hanger arm is in its fixed position.

In one embodiment, the hanger arm includes a locking mechanism. The locking mechanism is configured to engage a portion of the frame to retain the hanger arm in its fixed position.

In one embodiment, the hanger arm is pivotally coupled to the frame. The seat is movable in a swinging motion relative to the frame when the hanger arm is in its moving position.

In one embodiment, the seat portion includes a latch mechanism. The latch mechanism is configured to releasably engage a portion of one of the frame and the hanger arm for releasably securing the seat in its raised position.

The present invention is also directed to an infant support structure including a frame portion configured to be placed on a support surface, a support portion movably coupled to the frame portion, and a seat portion movably coupled to the support portion. The support portion has a released position and a locked position relative to the frame portion. The seat portion has a first position and a second position relative to the support portion. The seat portion is releasably securable in its second position when the support portion is in its locked position.

In one embodiment, the seat portion is restricted from being releasably secured in its second position unless the support portion is in its locked position. In one implementation, the support portion includes at least one arm. The seat portion is slidably coupled to the arm.

In one embodiment, the first position of the seat portion is a lowered position relative to the support surface. The second position of the seat portion is a raised position relative to the support surface.

In one embodiment, the frame portion includes a pair of hubs. The support portion includes a pair of arms pivotally supported by the hubs. The first position of the seat portion is a swinging position in which the seat portion moves in a swinging motion relative to the frame. The second position of the seat portion is a highchair position in which the seat portion is fixed relative to the frame. In one implementation, at least one of the hubs is configured to engage the seat portion and prevent the seat portion from being releasably secured in its second position when the support portion is in its released position.

In one embodiment, the support portion is pivotal about a first axis relative to the frame so that the seat portion is movable in a swinging motion relative to the frame when the support portion is in its released position. The frame portion includes a lower section configured for engaging the support surface and an upper section. The support portion is coupled to the upper section. The lower section is pivotal about a second axis relative to the upper section so that the frame portion is reconfigurable between a folded position and an extended position, the second axis being substantially parallel to the first axis.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

The terms "infant support structure" and "support structure" may be used interchangeably herein, and refer to a structure that can be used to support and/or retain a child or infant, such as for example a swing, an infant seat, and a high chair.

Figure 1:
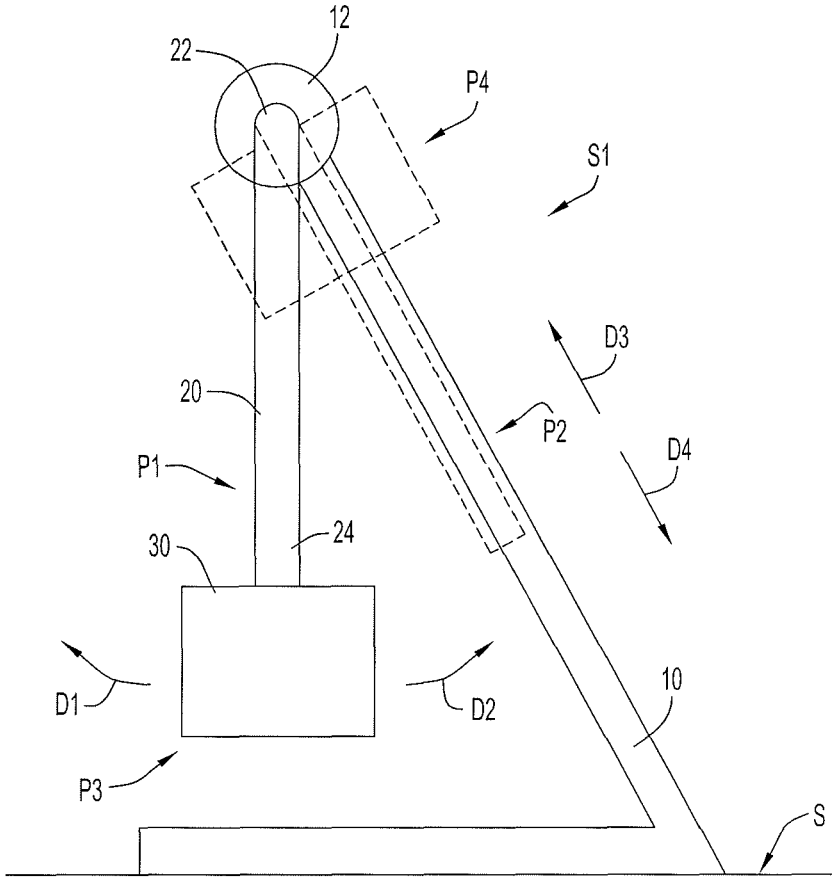
FIG. 1 illustrates a schematic diagram of an infant support structure according to an embodiment of the present invention.

FIG. 1 illustrates a schematic diagram of an infant support structure S1 according to an embodiment of the present invention. Infant support structure S1 includes a frame portion 10 configured to be placed on a support surface S, an arm or support portion 20 movably coupled to the frame portion 10, and a seat portion 30.

The support portion 20 is movable between a released position P1 and a locked position P2 (shown in phantom) relative to the frame portion 10. In one embodiment, the frame portion 10 includes a hub 12, and the support portion 20 includes an end portion 22 pivotally coupled to a hub 12 and an opposite end portion 24 coupled to the seat portion 30. In the released position P1, the support portion 20 is pivotally movable relative to the frame portion 10, so that the seat portion 30 is movable in a swinging motion back and forth in directions D1, D2 relative to the frame portion 10.

The seat portion 30 is movable between a lowered position P3 and a raised position P4 (shown in phantom) relative to the support portion 20, and relative to the support surface S. The seat portion 30 is releasably securable in its raised position P4 when the support portion 20 is in its locked position P2. Thus, the seat portion 30 is movable in a linear direction D3 toward the hub 12 and an opposite linear direction D4 away from the hub 12. The seat portion 30 is restricted from being releasably secured in its raised position P4 unless the support portion 20 is in its locked position P2. In other words, the seat portion 30 is not movable to its fully raised position P4 until the support portion 20 has been releasably secured in its locked position P2.

Figure 2:
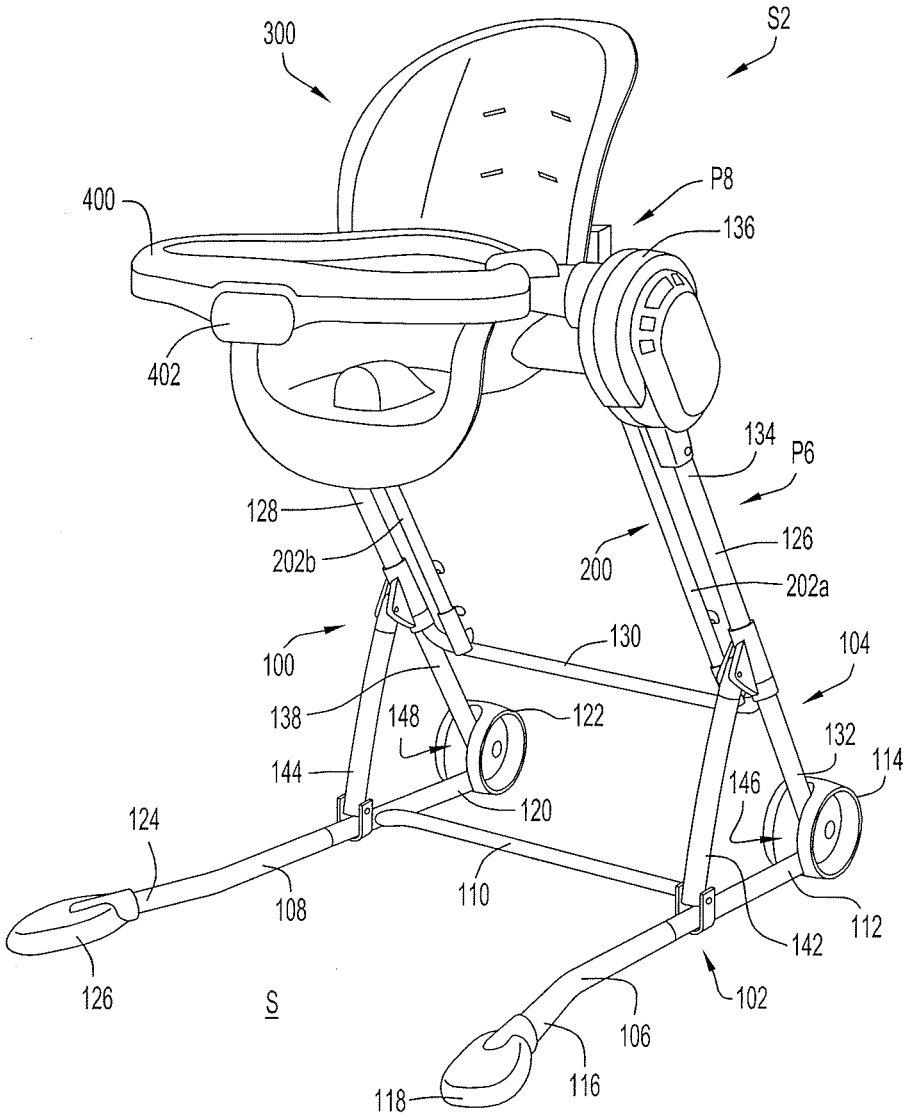
FIG. 2 illustrates a perspective view of an infant support structure according to another embodiment, showing a support portion in a locked position and a seat portion in a raised position.
Figure 3:
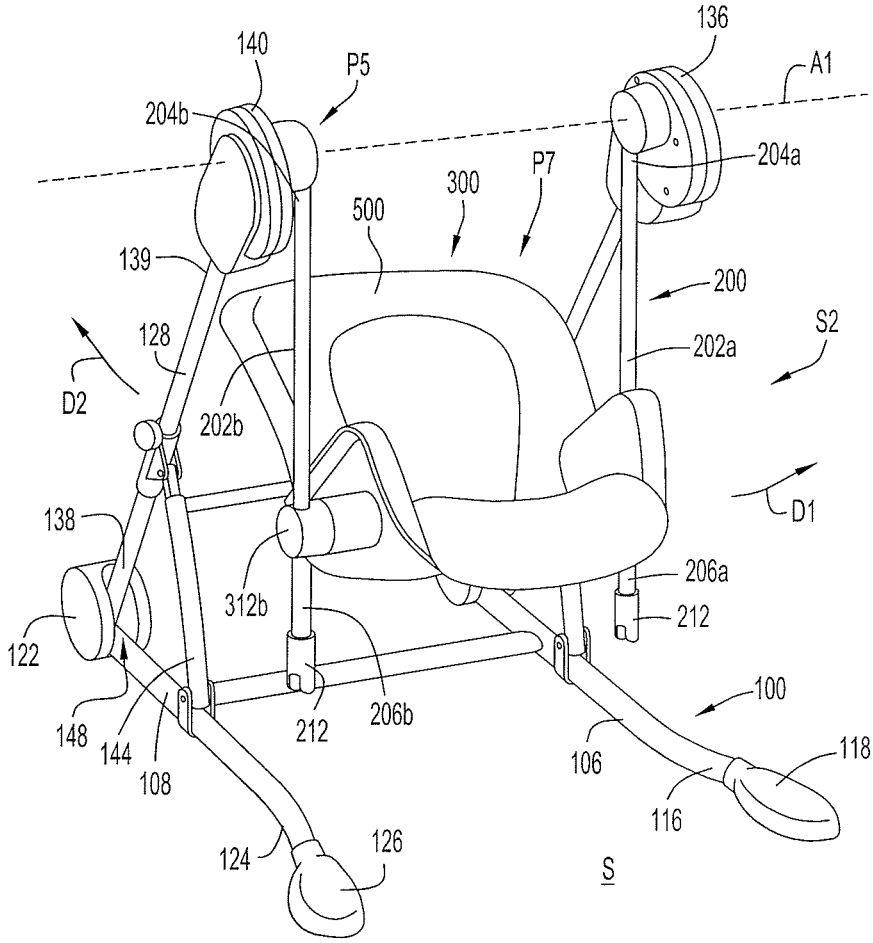
FIG. 3 illustrates a perspective view of the infant support structure of FIG. 2, showing the support portion in a released position and the seat portion in a lowered position.
Figure 4:
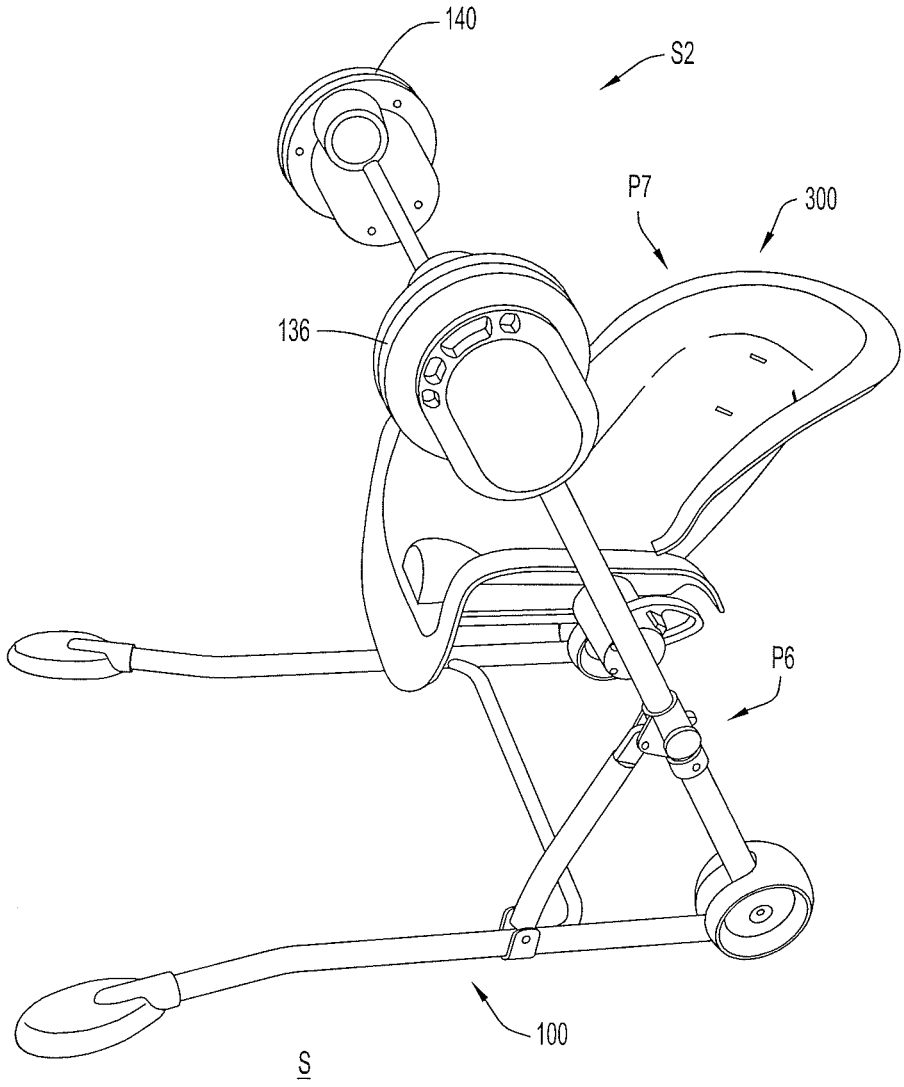
FIG. 4 illustrates a perspective view of the infant support structure of FIG. 2, showing the support portion in a locked position and the seat portion in a lowered position.

A reconfigurable infant support structure S2 according to another embodiment is illustrated in FIGS. 2, 3 and 4. The support structure S2 includes a frame 100, a support portion 200 coupled to the frame 100, and a seat portion 300 coupled to the support portion 200. The support portion 200 is movable between a released position P5 (shown in FIG. 3) in which the support portion 200 is movable relative to the frame 100, and a locked position P6 (shown in FIG. 2) in which the support portion 200 engages the frame 100. The seat portion 300 is linearly movable along the support portion 200 between a lowered position P7 (shown in FIGS. 3 and 4) and a raised position P8 (shown in FIG. 2).

In one embodiment, the infant support structure S2 further includes a tray 400, shown in FIG. 2, which is releasably attachable to the seat portion 300 and removable via actuation of a release button 402. The seat portion 300 may also include a flexible material, such as a softgoods or fabric material 500, shown in FIG. 3, which is coupled to the seat portion 300 and provides a comfortable and soft seating surface for an infant. In one embodiment, the fabric material 500 is removably coupled to the seat portion 300 to allow for washing of the fabric material 500. The fabric material 500 may be releasably attached to the seat portion 300 via conventional fastening mechanisms, such as snaps, clips, elastic straps, etc.

The support portion 200 is pivotal about an axis A1 relative to the frame 100, shown in FIG. 3. The seat portion 300 is movable in a swinging motion in directions D1, D2 relative to the frame 100, as shown in FIG. 3 (and such as shown schematically in FIG. 1) when the support portion 200 is in its released position P5. The seat portion 300 engages and is releasably secured to the frame 100 in its raised position P8 when the support portion 200 is in its locked position P6 (shown in FIGS. 2 and 4).

Referring to FIGS. 2 and 3, in one embodiment the frame 100 includes a lower section 102 configured to rest on a support surface S, and an upper section 104 coupled to and extending upwardly from the lower section 102. The lower section 102 includes spaced lower leg members 106, 108, and a lower crossbar 110 extending between and coupled to the lower leg members 106, 108. Lower leg member 106 has an end portion 112 coupled to a joint member 114, and an opposite distal end portion 116 coupled to a foot member 118. Similarly, lower leg member 108 has an end portion 120 coupled to another joint member 122, and an opposite distal end portion 124 coupled to another foot member 126.

The upper section 104 of the frame 100 includes spaced upper leg members 126, 128, and an upper crossbar 130 coupled to and extending between the upper leg members 126, 128. Upper leg member 126 includes an end portion 132 coupled to the joint member 114, and an opposite distal end portion 134 coupled to a hub 136. Upper leg member 128 includes an end portion 138 coupled to the joint member 122, and an opposite distal end portion 139 coupled to another hub 140 (see FIG. 3). As shown in FIG. 3, a brace 142 is coupled to and extends between the upper leg member 126 and the lower leg member 106. As shown in FIG. 2, another brace 144 is coupled to and extends between the upper leg member 128 and the lower leg member 108.

In one embodiment, the lower section 102 is pivotally coupled to the upper section 104 so that the frame 100 may be reconfigured between a folded configuration for storage or travel, and an extended or deployed configuration for use. The end portion 132 of the upper leg member 126 is pivotally coupled to the end portion 112 of the lower leg member 106. Joint member 114 includes slots or openings 146 through which end portions 132, 112 of the upper and lower leg members 126, 106, respectively, are inserted. Similarly, the end portion 138 of the upper leg member 128 is pivotally coupled to the end portion 120 of the lower leg member 108. Joint member 122 includes slots or openings 148 through which end portions 138, 120 of the upper and lower leg members 128, 108 are inserted, respectively. The slots 146, 148 permit pivotal movement of the lower section 102 and the upper section 104 relative to each other as the frame 100 is being reconfigured between its folded configuration and its extended configuration.

Figure 5:
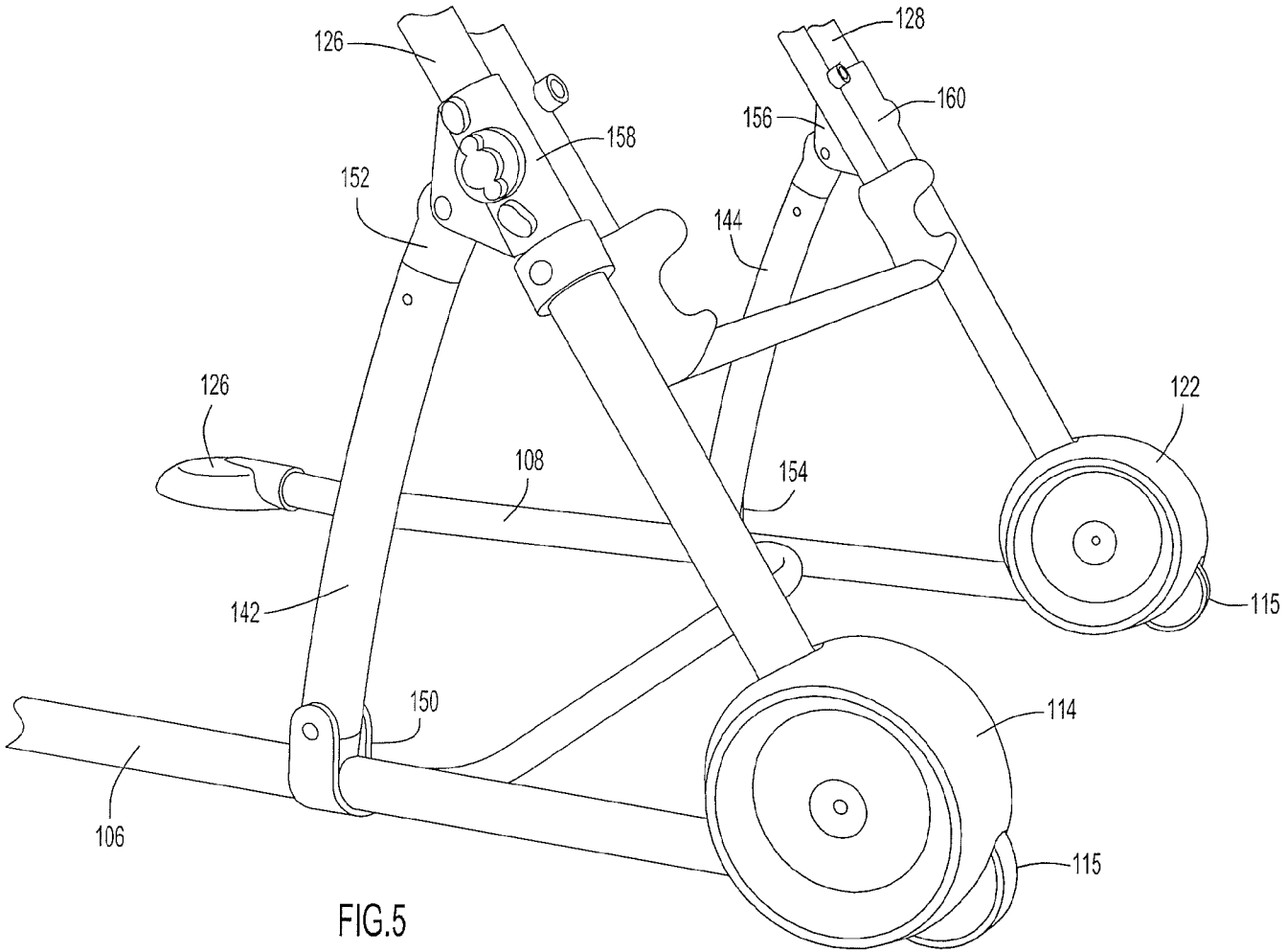
FIG. 5 illustrates a partial perspective view of portions of the frame of the infant support structure of FIG. 2.
Figure 6:
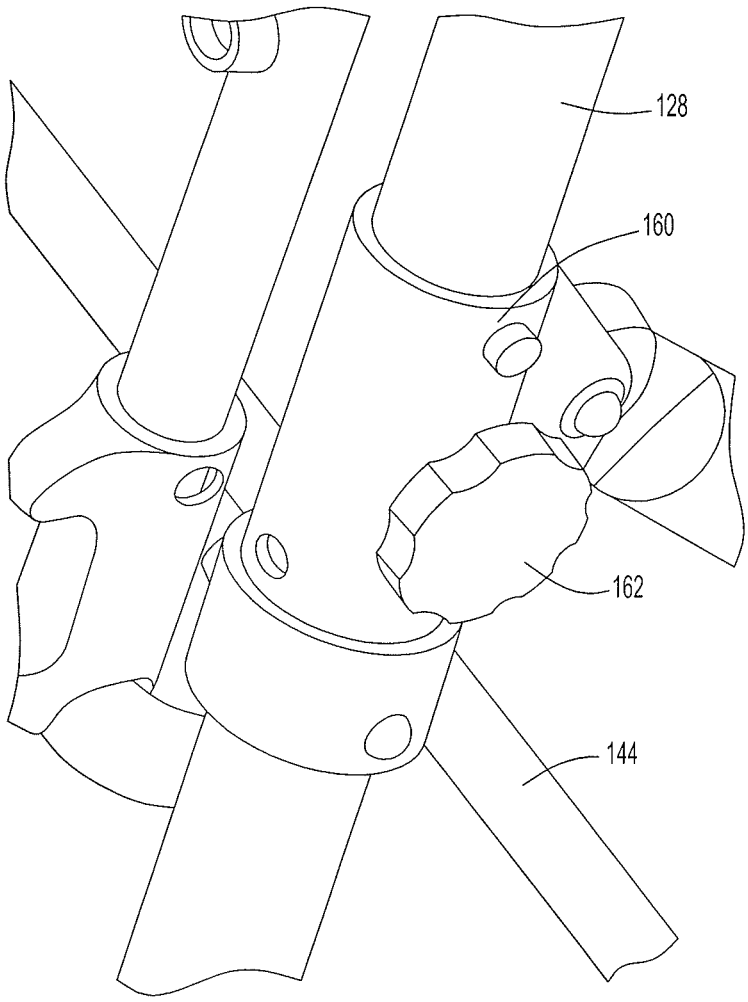
FIG. 6 illustrates an enlarged perspective view of portions of the frame.

Referring to FIG. 5, one or more wheels 115 may be rotatably coupled to portions of the frame, such as to each joint member 114, 122. The brace 142 includes an end 150 pivotally coupled to the lower leg member 106 and an opposite end 152 pivotally and slidably coupled to the upper leg member 126. Similarly, the brace 144 includes an end 154 pivotally coupled to the lower leg 108 and an opposite end 156 pivotally and slidably coupled to the upper leg member 128. In one implementation, the end 152 of the brace 142 is pivotally coupled to a collar 158 that is slidably disposed on the upper leg member 126, and the end 156 of the brace 144 is pivotally coupled to another collar 160 that is slidably disposed on the upper leg member 128. The collars 158, 160 slide upwardly on upper leg members 126, 128 and away from the joint members 114, 122 as the frame 100 is reconfigured from its extended position to its folded position. Referring to FIG. 6, a slide lock 162 may be operably associated with each collar 158, 160 (only collar 160 is shown for ease of reference) for releasably maintaining the collars 158, 160 in a selected position along the corresponding upper leg members 126, 128.

Figure 6A:
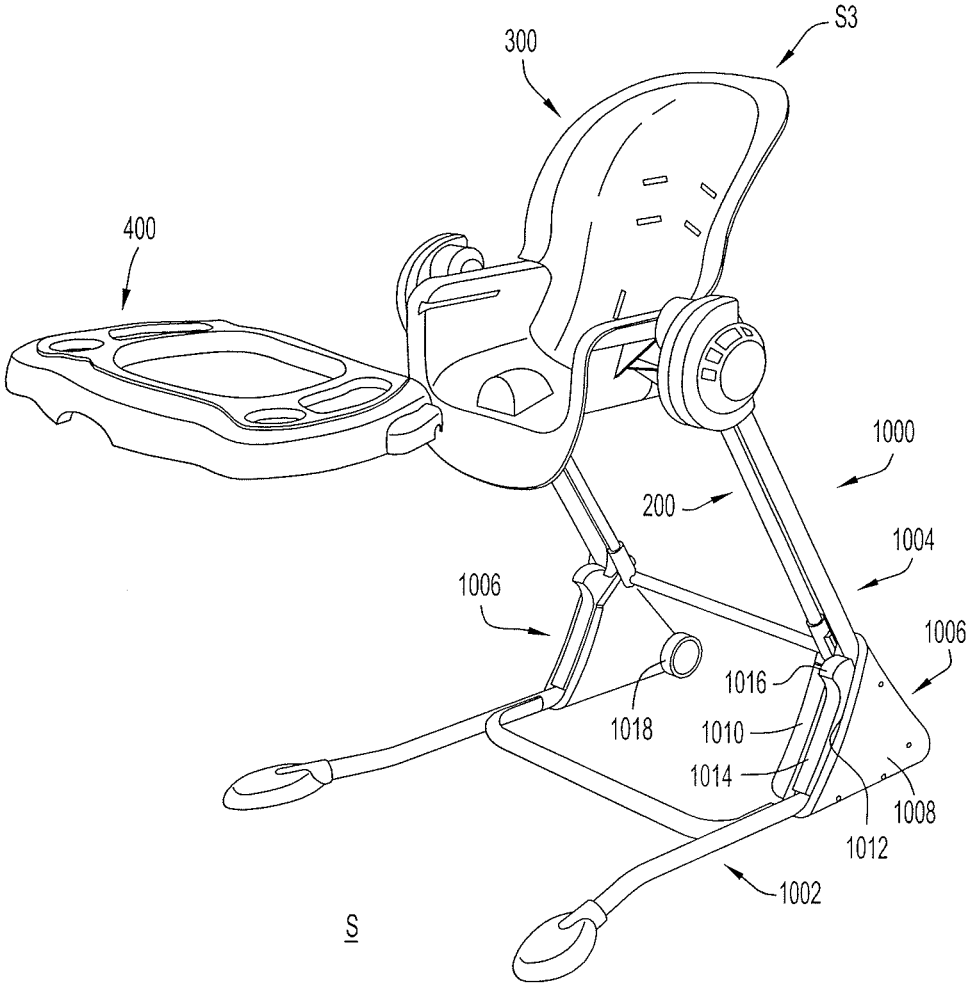
FIG. 6A illustrates a perspective view of an infant support structure including a frame according to another embodiment.

It should be understood that alternative configurations of the frame 100 may be employed. For example, as shown in FIG. 6A, an infant support structure S3 according to another embodiment includes a frame 1000. Support portion 200 is coupled to the frame 1000 and seat portion 300 is coupled to the support portion 200, as described above. A tray 400 can be coupled to the seat portion 300. Thus, the support portion 200 of infant support structure S3 is movable between a released position P5 (such as shown in FIG. 3) in which the support portion 200 is movable relative to the frame 1000, and a locked position P6 (such as shown in FIGS. 2 and 4) in which the support portion 200 engages the frame 1000. The seat portion 300 is linearly movable along the support portion 200 between a lowered position P7 (such as shown in FIGS. 3 and 4) and a raised position P8 (such shown in FIG. 2) relative to the frame 1000.

In this embodiment, the frame 1000 includes a lower section 1002 configured to rest on a support surface S, and an upper section 1004 coupled to and extending upwardly from the lower section 1002. The lower section 1002 is pivotally coupled to the upper section 1004 so that the frame 1000 may be reconfigured between a folded configuration for storage or travel, and an extended or deployed configuration for use. The upper section 1004 is pivotally coupled to the lower section 1002 via housing members 1006. Each housing member 1006 includes spaced sections 1008, 1010 which define a slot 1012. A retaining member 1014 is movably coupled to the housing member 1006. An end portion 1016 of the retaining member 1014 is pivotally movable between a position disposed within the slot 1012 and a position extending outwardly from the slot 1012. When the upper section 1004 is pivoted to its extended configuration relative to the lower section 1002, the retaining members 1014 may then be pivoted inwardly and block the slots 1012. The end portions 1016 of the retaining members 1014 may additionally engage or abut corresponding portions of the upper section 1004, so that the upper section 1004 is blocked from pivoting downwardly. The end portions 1016 of the retaining members 1014 may be pivoted outwardly and away from the slots 1012, thereby permitting the upper section 1004 to be pivoted downwardly and toward the lower section 1002, so that the frame 1000 may be reconfigured to its folded position. One or more wheels 1018 may be rotatably coupled to portions of the frame, such as to each housing member 1006.

Figure 6B:
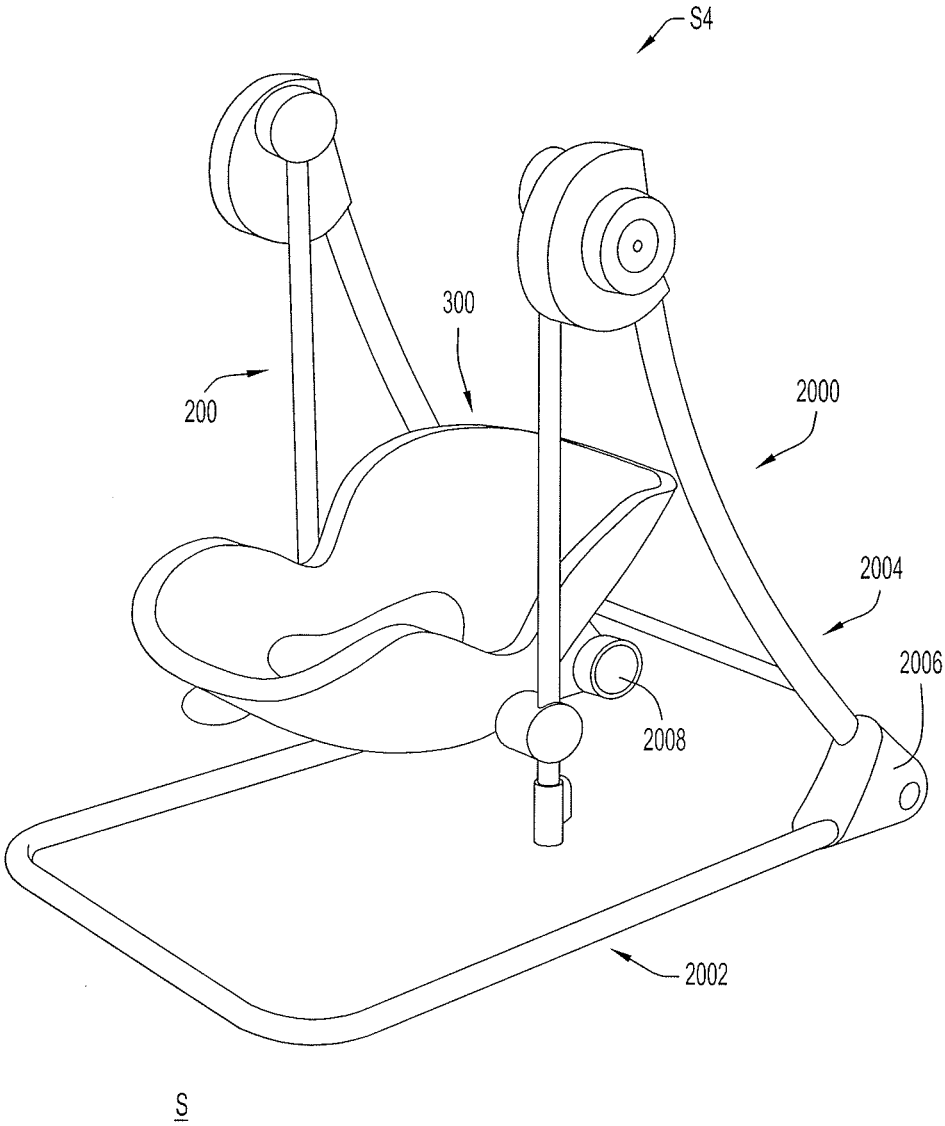
FIG. 6B illustrates a perspective view of an infant support structure including a frame according to another embodiment.

Alternatively, an infant support structure S4 according to another embodiment includes a frame 2000, as shown in FIG. 6B. Support portion 200 is coupled to the frame 2000 and seat portion 300 is coupled to the support portion 200, as described above. Thus, the support portion 200 of infant support structure S4 is movable between a released position P5 (such as shown in FIGS. 3 and 6B) in which the support portion 200 is movable relative to the frame 2000, and a locked position P6 (such as shown in FIGS. 2 and 4) in which the support portion 200 engages the frame 2000.

Frame 2000 includes a lower section 2002 configured to rest on a support surface S, and an upper section 2004 coupled to and extending upwardly from the lower section 2002. The lower section 2002 is coupled to the upper section 2004 via joints 2006. In one embodiment, the upper section 2004 and/or the lower section 2002 are fixedly attached to the joints 2006. In other embodiments, the joints 2006 include a bore or opening configured to receive portions of the upper section 2004, so that the upper section 2004 may be detached from the lower section 2002, such as for storage or travel. One or more wheels 2008 may be rotatably coupled to portions of the frame, such as to each joint 2006.

Referring again to FIGS. 2 and 3, in one embodiment the support portion 200 includes a right hanger arm 202*a* and a left hanger arm 202*b*. The right hanger arm 202*a* includes an end portion 204*a* coupled to the hub 136 of the frame 100 and an opposite distal end portion 206*a*. Similarly, the left hanger arm 202*b* includes an end portion 204*b* coupled to the other hub 140 of the frame 100 and an opposite distal end portion 206*b*. The seat portion 300 is slidably retained on the left and right hanger arms 202*a*, 202*b*.

Figure 7:
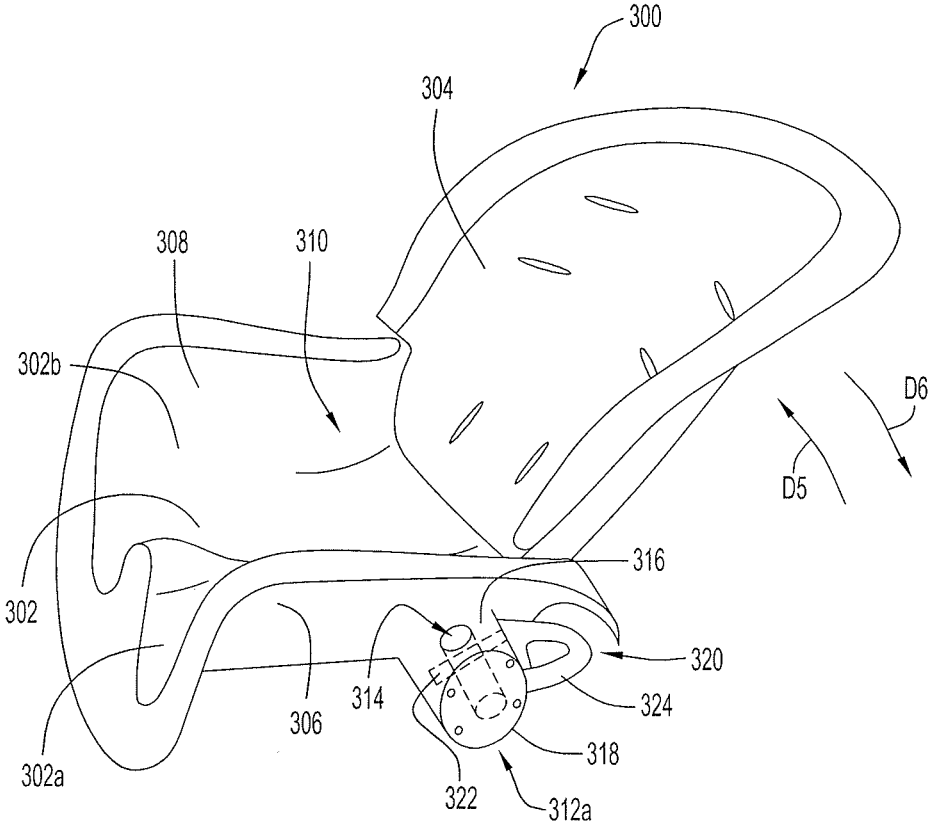
FIG. 7 illustrates a side perspective view of the seat portion of an infant support structure.

Referring to FIG. 7, the seat portion 300 includes a bottom section 302, a back section 304 extending upwardly from and connected to the bottom section 302, a right side section 306 extending upwardly from and connected to a side portion 302*a* of the bottom section 302, and a left side section 308 extending upwardly from and connected to an opposing side portion 302*b* of the bottom section 302. The bottom section 302, back section 304, and left and right side sections 306, 308 collectively define a seating area 310 configured for supporting an infant therein.

Figure 7A:
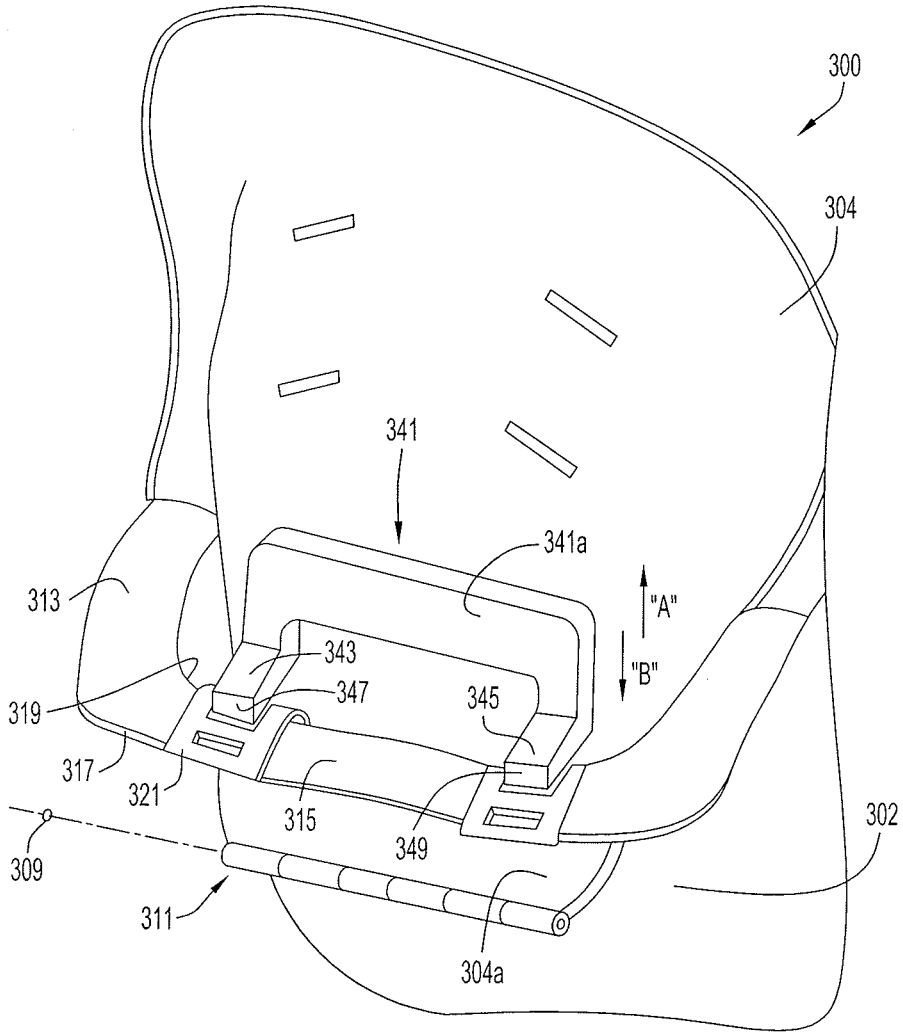
FIG. 7A illustrates a rear perspective view of the seat portion of FIG. 7.

Referring to FIGS. 7 and 7A, in one embodiment, the back section 304 is pivotally coupled to the bottom section 302 via a hinge structure 311 that defines an axis 309 about which the back section 304 can pivot relative to the bottom section 302. Accordingly, the angle of inclination of the back section 304 can be adjusted relative to the bottom section 302 about axis 309 along the directions of arrows "D5" and "D6." The bottom section 302 includes a lip or lip portion 313 that extends around the rear of the bottom section 302. The lip 313 has an upper surface 315 and edges 317 and 319.

As shown in FIG. 7A, positioning members 321 and 331 are coupled to the lip 313. In this embodiment, the positioning members 321 and 331 are formed separately and coupled or snapped onto the lip 313. In alternative embodiments, the positioning members 321 and 331 can be integrally formed in the lip 313. Positioning member 321 includes openings 323 and 325 and positioning member 331 includes openings 333 and 335. In alternative embodiments, the quantity of openings formed in a positioning member may be more than two.

The seat 300 includes a recline mechanism 341 with a body 341A that is slidably coupled to the rear surface of the back section 304. The body 341A includes ends or end portions 343 and 345 that have distal tips 347 and 349, respectively. The tips 347 and 349 are engageable with the openings in the positioning members 321 and 331, respectively. Depending on which of the openings that the tips 347 and 349 engage, the back section 304 is maintained at a particular orientation relative to the bottom section 302. The body 341A is biased in along the direction of arrow "B" by a biasing mechanism, such as a spring, into a locking position. A user can release the recline mechanism 341 by moving the body 341A along the direction of arrow "A" against the biasing mechanism and disengaging the tips 347 and 349 from the openings. Thus, the angle of inclination of the back section 304 can be easily adjusted by a user by the movement of the recline mechanism 341.

A slide or coupling member 312*a* extends outwardly from a side of the seat 300. The slide member 312*a* is coupled to the bottom section 302 and/or to the right section 306 of the seat portion 300. In one embodiment, the slide member 312*a* is integrally formed with the seat 300. The slide member 312*a* defines a bore 314 extending between and in communication with an upper side 316 and a lower side 318 of the slide member 312*a*. The right hanger arm 202*a* (shown in FIG. 3) passes through the bore 314. The slide member 312*a* is slidably movable along the right hanger arm 202*a* between its end portion 204*a* and its end portion 206*a*.

Figure 8:
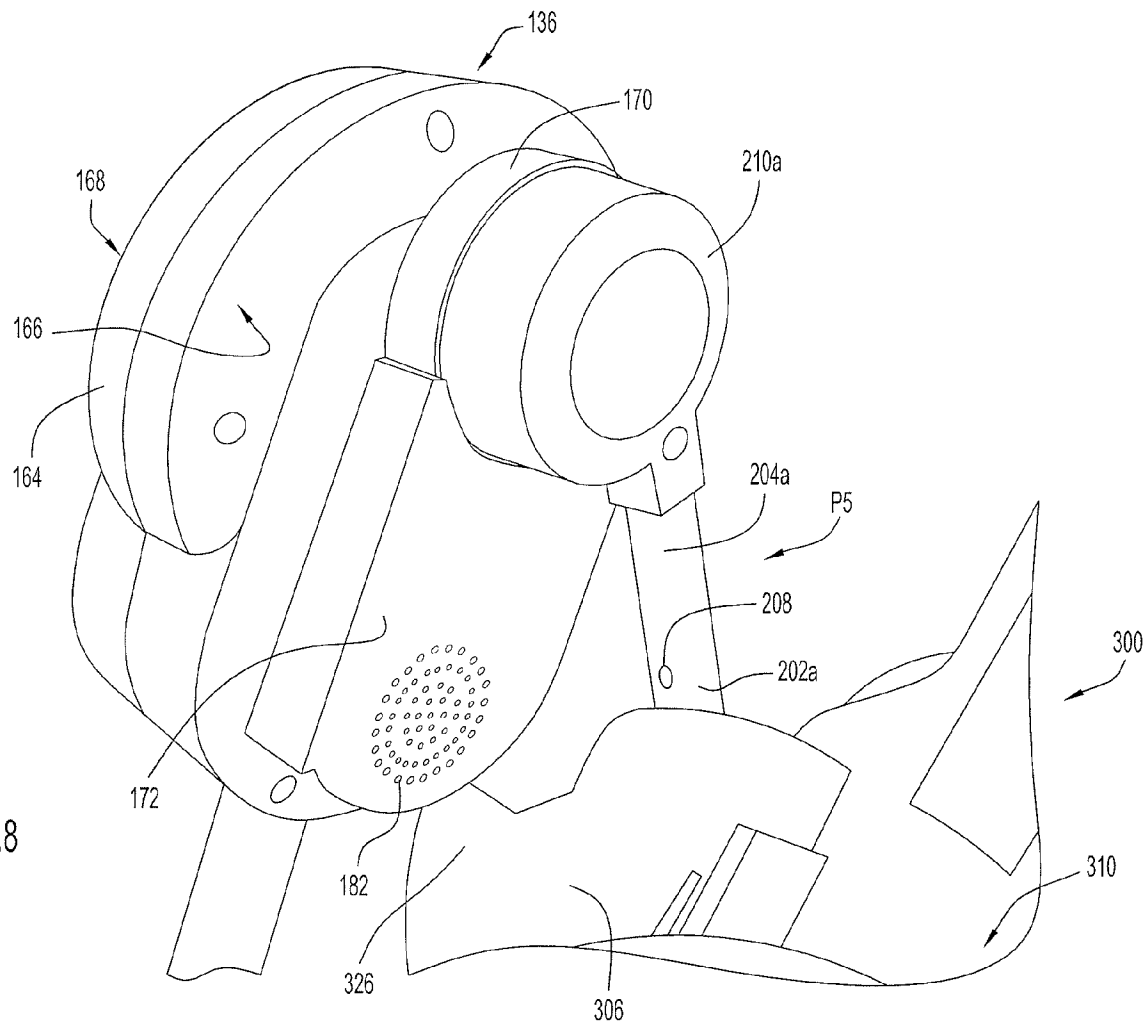
FIG. 8 illustrates a perspective view of a hub of the frame and portions of the seat portion of an infant support structure showing engagement members obstructing movement of the seat portion.

In one embodiment, a latch mechanism 320 is coupled to the slide member 312*a* and configured to releasably maintain the slide member 312*a* at a selected position along the right hanger arm 202*a*. For example, the latch mechanism 320 may include a pin 322 (shown in phantom in FIG. 7) that is movable between a latched position extending through a correspondingly configured opening in communication with the bore 314, and an unlatched position pulled outwardly and away from the bore 314. The pin 322 is biased toward a latched position via a resilient member, such as a spring, but may be moved outwardly to its unlatched position by pulling outwardly on a handle 324 connected to the pin 322. The pin 322 is alignable with and received in a selected opening 208 in the right hanger arm 202*a* (such as shown in FIG. 8).

Another slide member 312*b* (shown in FIG. 3) extends outwardly from the opposite side portion 302*b* of the bottom section 302 and/or the left side section 308. Slide member 312*b* has a configuration substantially identical to slide member 312*a* (as shown in FIG. 7). Thus, slide member 312*b* includes a bore 314 through which the left hanger arm 202*b* passes. Slide member 312*b* is slidably movable along the left hanger arm 202*b* between its end portion 204*b* and its end portion 206*b*. Another latch mechanism 320 is coupled to the slide member 312*b* and configured to releasably maintain the slide member 312*b* at a selected position along the left hanger arm 202*b*, as described above.

It should be understood that other latching mechanisms may be employed for releasably retaining the slide members 312*a*, 312*b* at a selected position along the right and left hanger arms 202*a*, 202*b*. In an alternative embodiment, latch mechanisms are coupled to the seat portion 300 and configured to releasably secure the slide mechanisms 312*a*, 312*b* (or another component of the seat portion 300) to the frame 100, such as to correspondingly configured portions of the hubs 136, 140 of the frame 100.

Thus, the latch mechanisms (e.g. latch mechanisms 320) are configured to releasably engage a portion of the right and/or left hanger arms 202*a*, 202*b* and/or a portion of the frame 100 so that the seat portion 300 is releasably securable in its raised position P8 (shown in FIG. 2). The seat portion 300 is fixed relative to the frame 100 when releasably secured in its raised position P8.

Figure 7B:
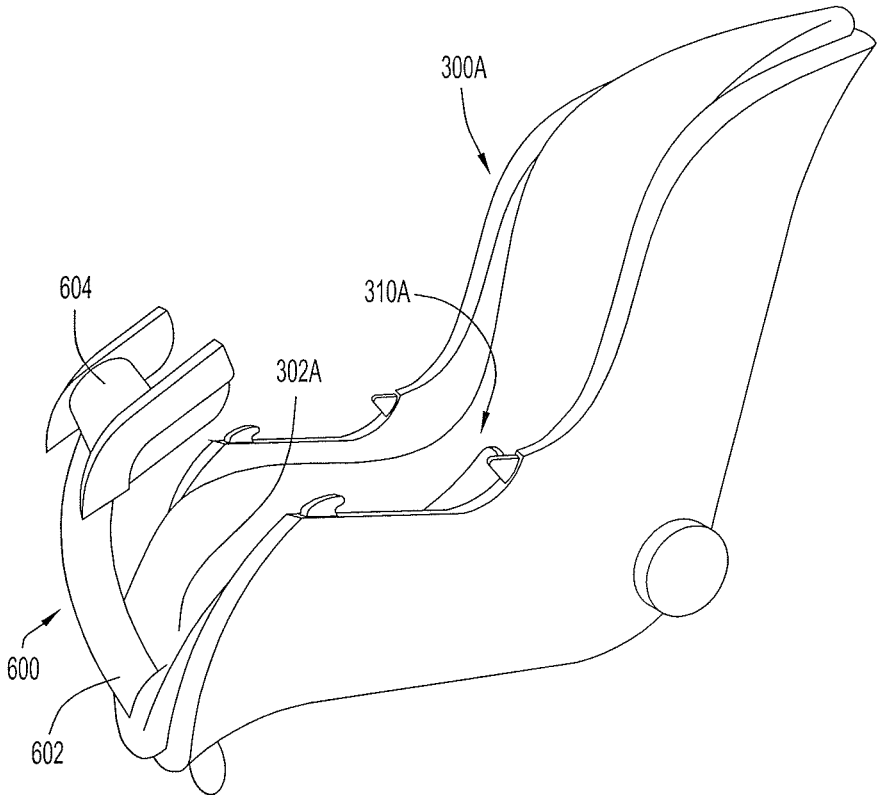
FIG. 7B illustrates a perspective view of a seat portion according to another embodiment.

The seat portion 300 may include components for safely securing an infant in the seating area 310. For example, as illustrated in FIG. 7B, in one embodiment, a seat portion 300A includes a T-bar structure 600. T-bar structure 600 includes an end 602 pivotally coupled to a bottom section 302A, and a distal member 604 movable between a position proximate the bottom section 302A and a position spaced from the bottom section 302A. The T-bar structure is configured to pivot inwardly and above or against an infant's legs when the infant is in a seating area 310A defined by the seat portion 300A.

Figure 9:
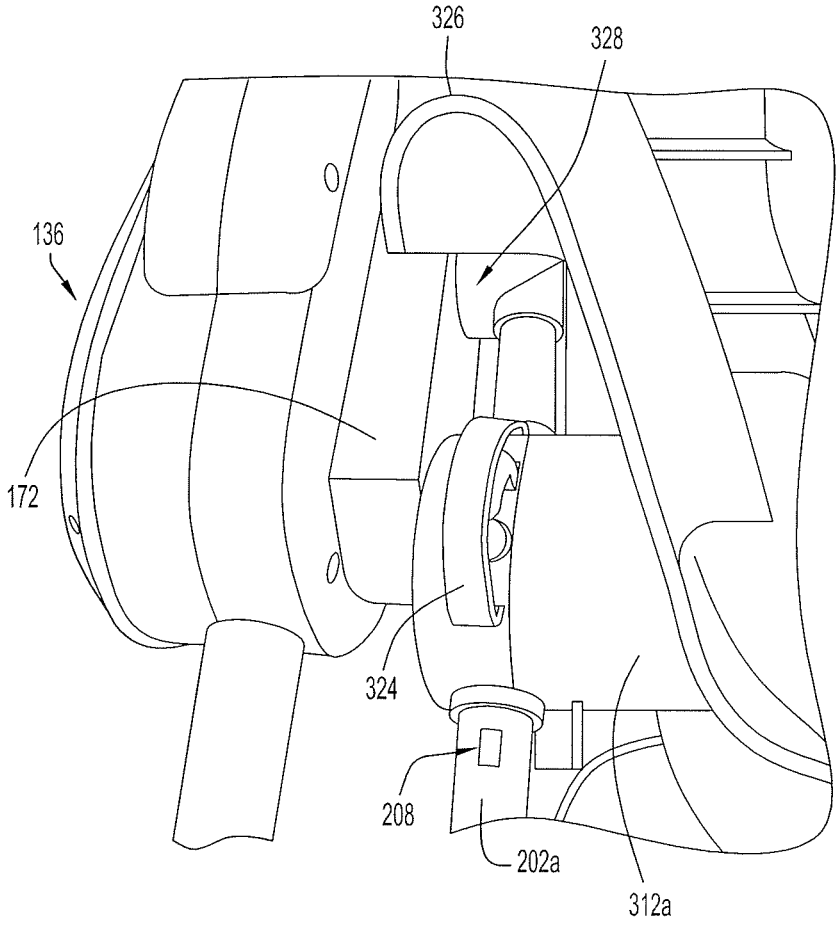
FIG. 9 illustrates an enlarged perspective view of a locking mechanism and a latch mechanism of an infant support structure.

Referring to FIGS. 8 and 9, at least one of the hubs 136, 140 and the seat portion 300 are correspondingly configured so that the seat portion 300 is blocked from moving into its fully raised position P8 when the hanger arms 202*a*, 202*b* of the support portion 200 are in their released position P5 (shown in FIGS. 3 and 8). The seat portion 300 is only movable and releasably securable in its fully raised position P8 when the hanger arms 202*a*, 202*b* are in the locked position P6 (shown in FIG. 2).

In one embodiment, hub 136 includes a body 164 having an inwardly facing surface 166 and an outwardly facing surface 168. The end portion 204*a* of the right hanger arm 202*a* includes a cap 210*a* pivotally coupled to a mounting portion 170 provided on the inwardly facing surface 166 of the body 164. The seat portion 300, which is coupled to the hanger arms 202*a*, 202*b*, is thereby movable in a swinging motion in directions D1, D2 (shown in FIG. 3) relative to the frame 100 when the hanger arms 202*a*, 202*b* are in their released position P5. The hub 136 also includes an engagement member 172. The engagement member 172 is coupled to and extends outwardly from the inwardly facing surface 166 and below the mounting portion 170.

The right side 306 of the seat portion 300 includes another engagement member 326 extending outwardly from the seating area 310. As shown in FIG. 9, the right section 306 also includes or defines a receiving area 328 beneath or proximate to the engagement member 326. The engagement member 326 of the seat portion 300 is configured to contact the engagement member 172 of the hub 136 when the hanger arms 202*a*, 202*b* are in their released position P5, as shown in FIG. 8. Thus, in the released position P5, movement of the seat portion 300 is obstructed by the contacting of the engagement members 172, 326 with each other if the seat portion 300 is moved upwardly along the hanger arms 202*a*, 202*b* toward its raised position P8. In this way, the engagement member 172 of the hub 136 contacts the engagement member 326 of the seat portion 300, and prevents the seat portion 300 from being releasably secured in its raised position P6 when the support portion 200 is in its released position P5. As a result, the seat 300 is not retained in or movable to its raised position corresponding to a highchair configuration unless the support portion 200 is fixed in place and no longer swinging relative to the frame. Thus, parents or caregivers can place an infant in a desired highchair position for feeding or other stationary activities.

Figure 10:
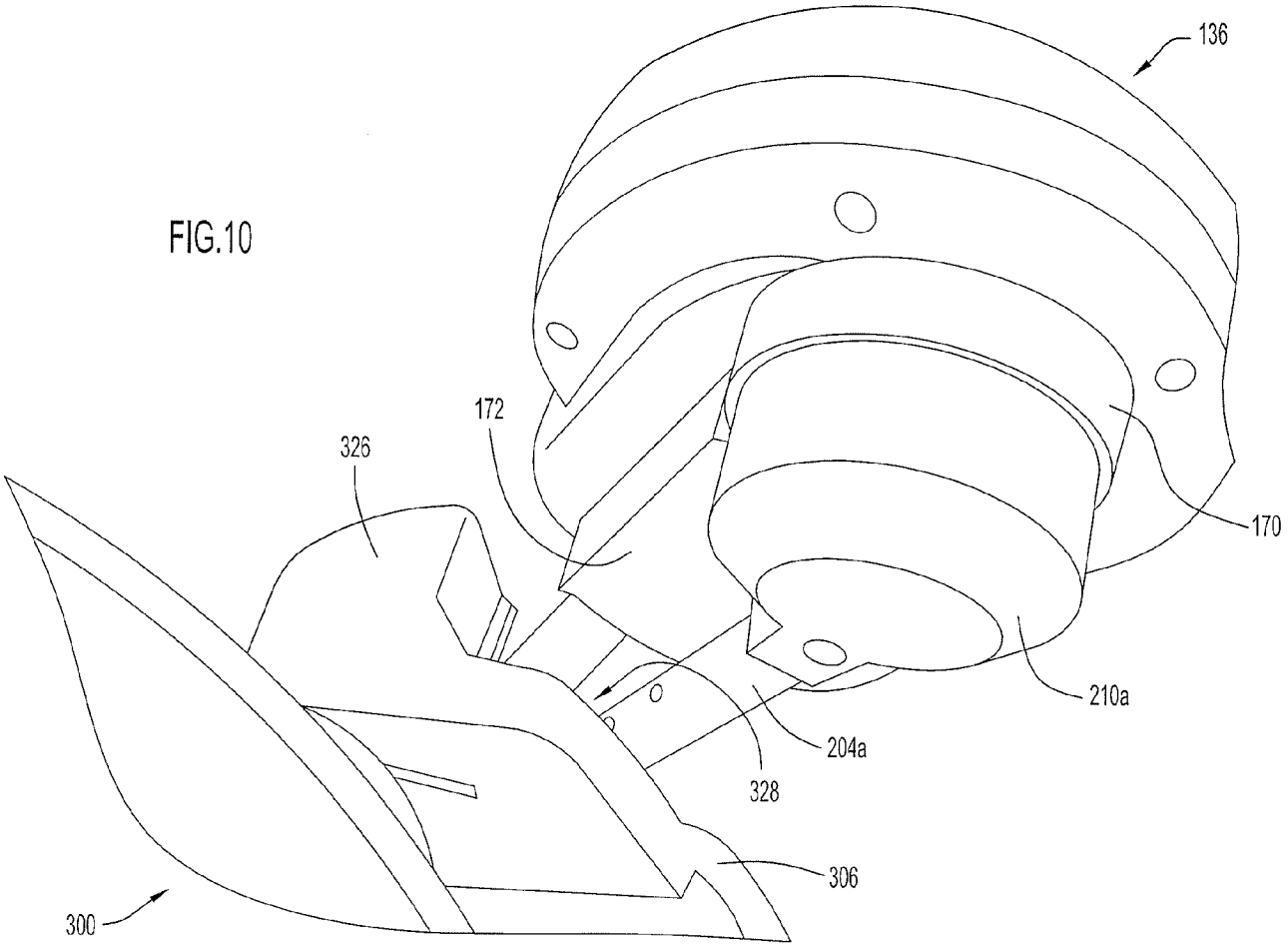
FIG. 10 illustrates a perspective view of the hub of the frame and portions of the seat portion of an infant support structure showing the engagement members offset.
Figure 11:
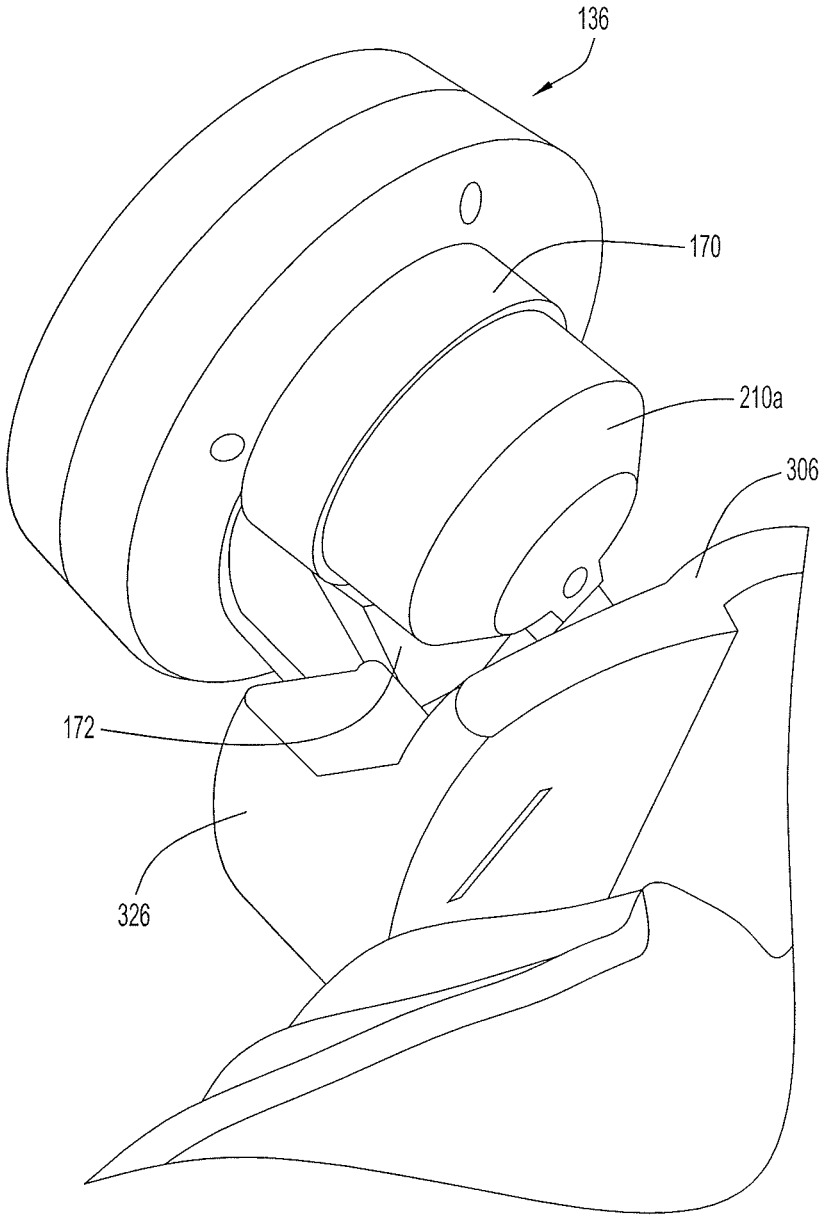
FIG. 11 illustrates a perspective view of the hub of the frame and portions of the seat portion of an infant support structure showing the engagement member of the hub received in the receiving area of the seat portion.

When the hanger arms 202*a*, 202*b* are in their locked position P6 (shown in FIG. 4), the engagement member 172 of the hub 136 is offset from the engagement member 326 of the seat portion 300, as shown in FIGS. 9 and 10. Thus, the seat portion 300 may be moved upwardly along the hanger arms 202*a*, 202*b* to its fully raised position P8 (shown in FIG. 2). As the seat portion 300 is moved to its raised position P8, the engagement member 172 of the hub 136 is received in the receiving area 328 of the seat portion 300, as shown in FIGS. 9 and 11.

In one embodiment, the configuration of hub 140 may be substantially identical to hub 136 except that it is a minor image of hub 136. Accordingly, the end portion 204*b* of the left hanger arm 202*b* is pivotally coupled to an inwardly facing surface of hub 140. Hub 140 also includes another engagement member similarly configured to the engagement member 172, which cooperates with a correspondingly configured engagement member and receiving area on the left side section 308 of the seat portion 300. In other embodiments, hub 140 does not include an engagement member for blocking movement of the seat portion 300 to its raised position P8 (provided that the engagement member 172 on hub 136 blocks such movement).

Figure 12:
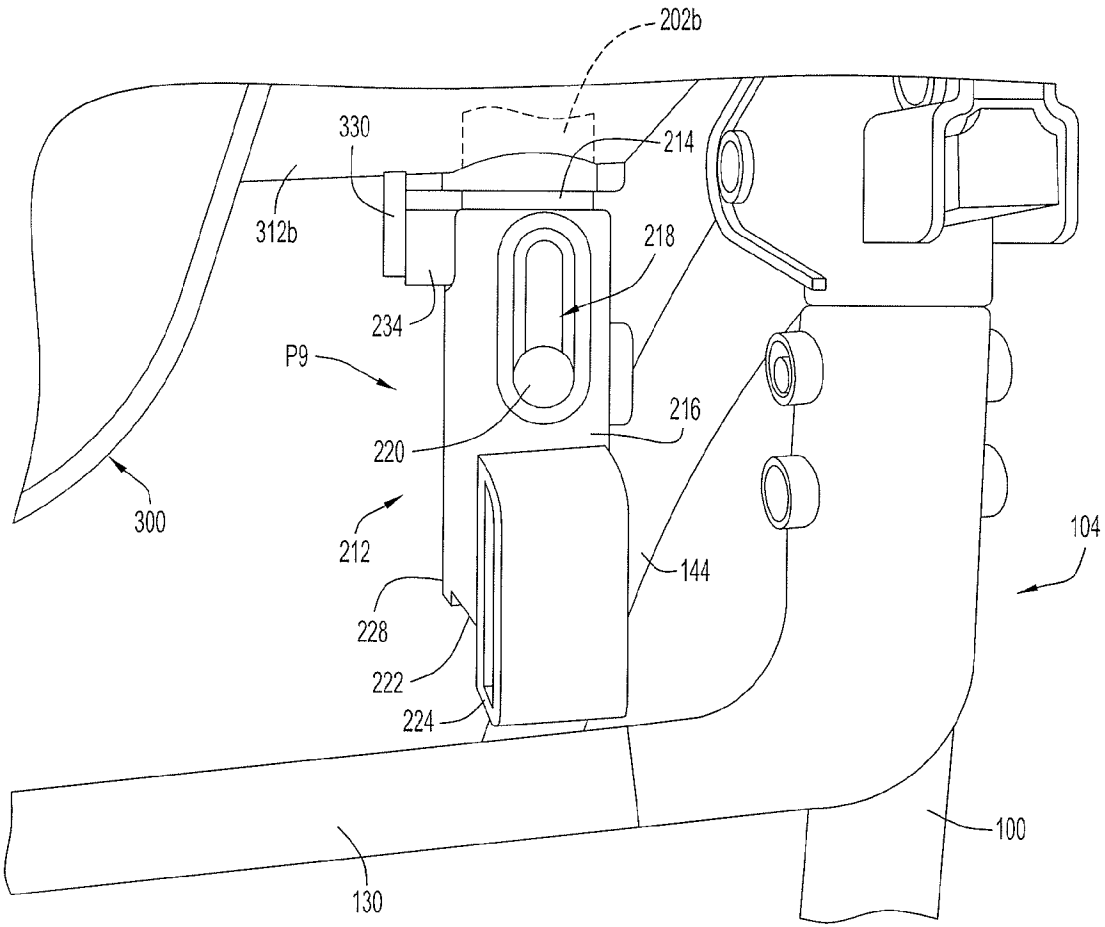
FIG. 12 illustrates a perspective view of the locking mechanism of an infant support structure in a retracted position.
Figure 13:
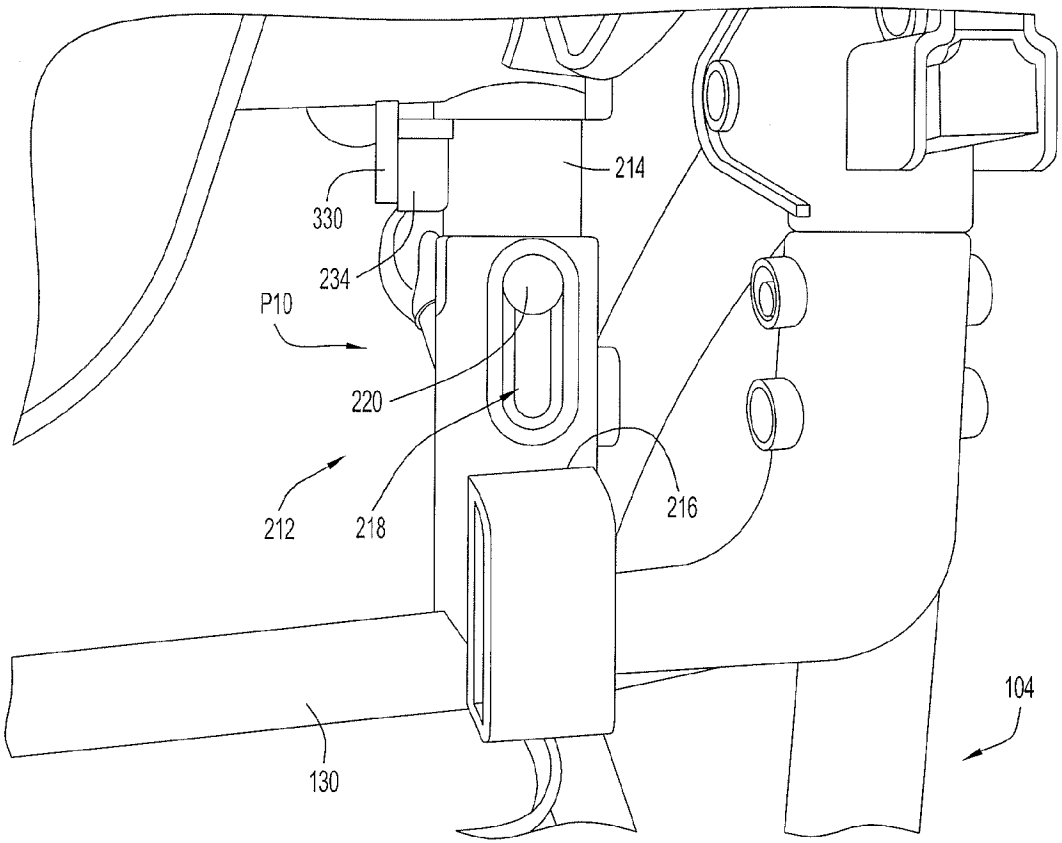
FIG. 13 illustrates a perspective view of the locking mechanism of an infant support structure in an unlocked and deployed position.

Referring to FIGS. 12 and 13, in one embodiment, each of the distal end portions 206*a*, 206*b* of the hanger arms 202*a*, 202*b* (only hanger arm 202*b* shown for ease of reference) includes a locking mechanism 212 movable between a retracted position P9 (see FIG. 12) disengaged from the frame 100, and a deployed position P10 (see FIG. 13) engaging a portion of the frame 100 and retaining the corresponding hanger arm 202*a*, 202*b* in a fixed position relative to the frame 100. In one embodiment, the locking mechanism 212 engages the upper crossbar 130 of the upper section 104 of the frame 100.

The locking mechanism 212 includes an upper portion 214 and a lower portion 216 telescopically coupled to the upper portion 214. The lower portion 216 defines a slot 218. A retaining pin 220 extends through the slot 218 and is connected to the upper portion 214. The lower portion 216 is extendable away from the upper portion 214 as the locking mechanism 212 is moved from its retracted position P9 (shown in FIG. 12) to its deployed position P10 (shown in FIG. 13). Likewise, the lower portion 216 is retractable toward the upper portion 214 as the locking mechanism 212 is moved from its deployed position P10 to its retracted position P9. The range of motion of the lower portion 216 relative to the upper portion 214 is restricted or limited to the range of movement of the retaining pin 220 between opposing ends of the slot 218.

Figure 14:
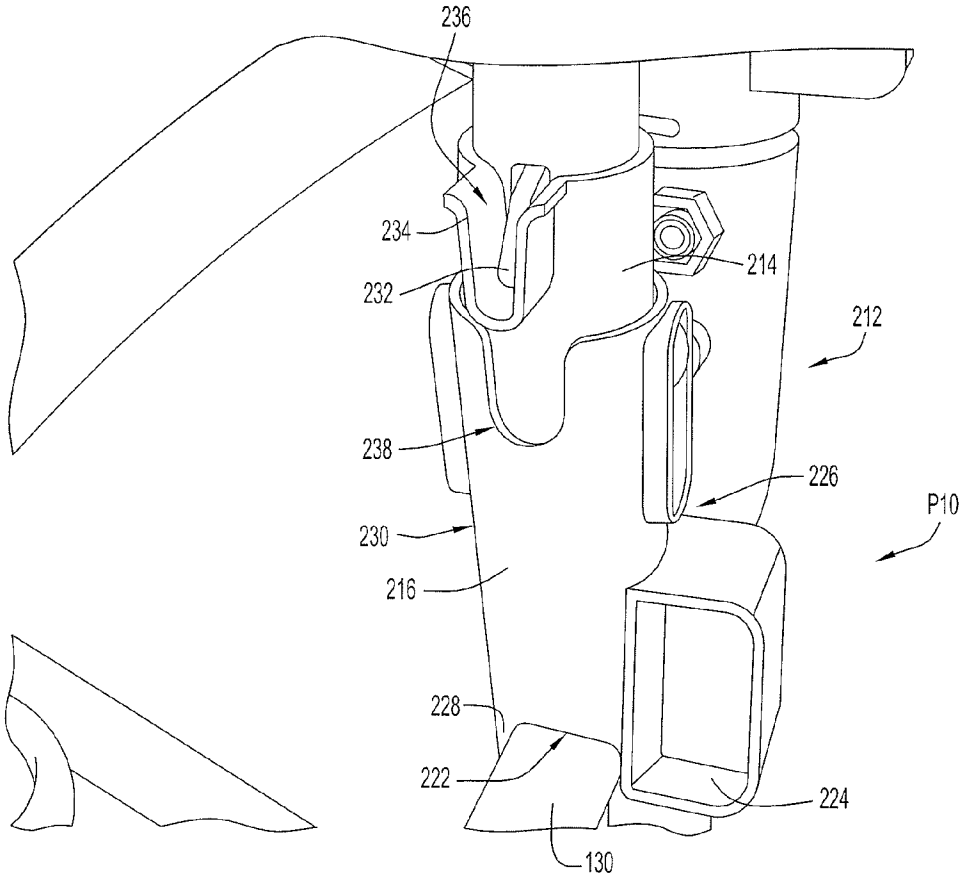
FIG. 14 illustrates another perspective view of the locking mechanism of an infant support structure in a locked and deployed position.

Referring to FIG. 14, the lower portion 216 includes a base 222 configured to engage the upper crossbar 130 when the locking mechanism 212 is in its deployed position P10. A buttress 224 extends outwardly from a side 226 of the lower portion 216 and beyond the surface defining the plane on which the base 222 lies on the crossbar 130. A ridge 228 extends outwardly from an opposite side 230 of the lower portion 216 and beyond the plane on which the base 222 lies. The base or base surface 222, the buttress 224, and the ridge 228 together define a C-shaped or inverted U-shaped receptacle or area for receiving or retaining the upper crossbar 130.

The buttress 224 prevents the locking mechanism 212 and thus the corresponding hanger arm 202*a*, 202*b* from sliding away from the upper crossbar 130 in direction D1 (shown in FIG. 3), even if the hanger arms 202*a*, 202*b* are bumped and/or additional weight is applied to the hanger arms 202*a*, 202*b* (e.g. when an infant is placed in the seating area 310). Similarly, the ridge 228 prevents the locking mechanism 212 and thus the corresponding hanger arms 202*a*, 202*b* from sliding away from the upper crossbar 130 in direction D2 (shown in FIG. 3), even if the hanger arms 202*a*, 202*b* are bumped or jostled. Note that the forces acting upon the locking mechanisms 212 and hanger arms 202*a*, 202*b* are primarily directed downwardly. In one embodiment, the buttress 224 is more substantial or is larger in size than the ridge 228. In one embodiment, each of the components of the locking mechanism 212 except for the pin 220 can be molded plastic.

In one embodiment, the locking mechanism 212 is lockable in its deployed position P10, such as via a spring loaded catch, until released by actuating a release trigger 232 operably associated with the catch. The catch is actuated when the lower portion 216 of the locking mechanism 212 is pulled outwardly and away from the upper portion 214 to the deployed position P10, and the release trigger is deactivated (such as shown in FIG. 14). Thus, the catch maintains the locking mechanism 212 in a locked and deployed position P10 until released via depression of the release trigger 232.

With continued reference to FIG. 14, in one embodiment, the upper portion 214 includes an outwardly extending jacket member 234 extending around the release trigger 232. The jacket member 234 has a generally U-shaped configuration with an open top portion 236. The lower portion 216 includes a recess 238 correspondingly configured to receive the jacket member 234 when the locking mechanism 232 is in its retracted position P9, as shown in FIG. 12.

Figure 15:
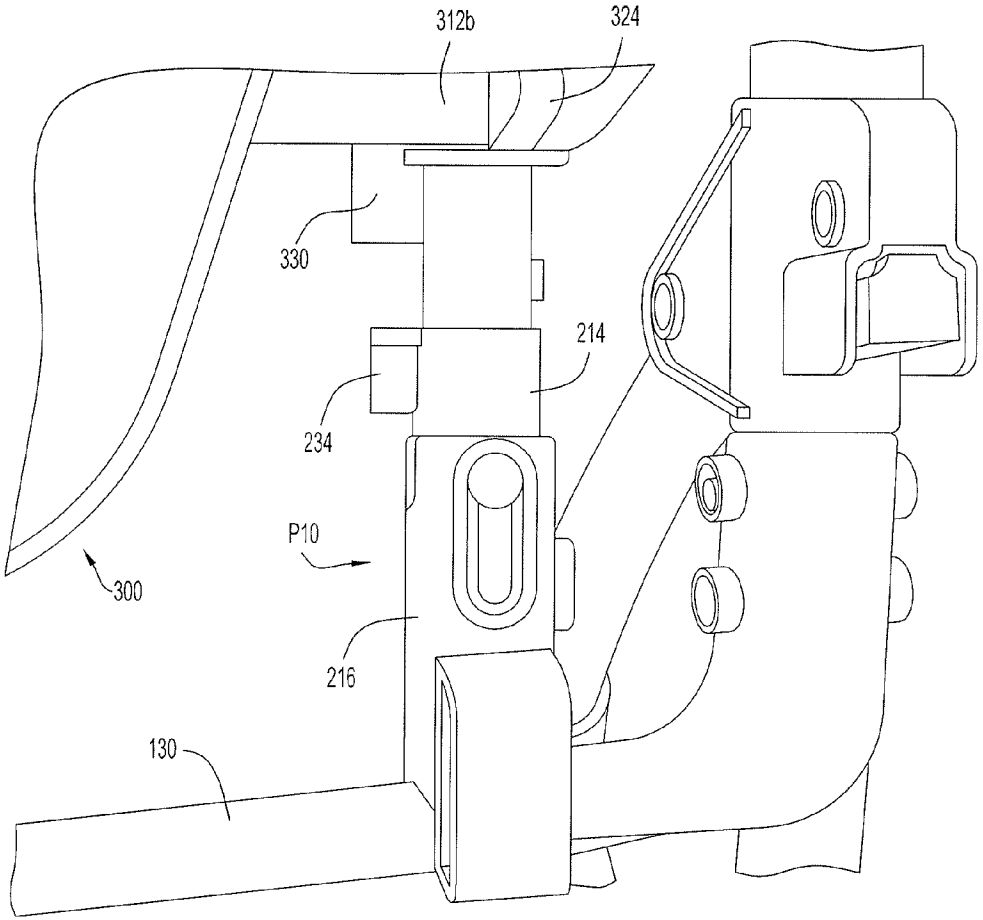
FIG. 15 illustrates another perspective view of the locking mechanism of an infant support structure in a locked and deployed position.

Referring to FIG. 15, the seat portion 300 includes a projection 330 extending outwardly from the underside 318 of the slide member 312*b* (or slide member 312*a*). The projection 330 is aligned with and received in the open top portion 236 of the jacket member 234 (as shown in FIGS. 12 and 13) when the seat portion 300 is in its lowered position P7. The projection 330 is seated within the jacket member 234 and engages the release trigger 232 (shown in FIG. 14) when the seat portion 300 is in its lowered position P7, so that the catch of the locking mechanism 212 is maintained in a deactivated state.

In some embodiments, the distal end portions 206*a*, 206*b* of both the right hanger arm 202*a* and the left hanger arm 202*b* include locking mechanisms 212 (as shown in FIG. 3). In other embodiments, only one of the distal end portions 206*a*, 206*b* of the hanger arms 202*a*, 202*b* include a locking mechanism 212.

When the hanger arms 202*a*, 202*b* are in their released position P5 (shown in FIG. 3), the seat portion 300 is in its lowered position P7. The projection 330 on the slide member 312*a* (and/or slide member 312*b*) is seated within the corresponding jacket member 234 and depressing an associated release trigger 232. As such, the locking mechanism 212 is in an unlocked and retracted position P9 (shown in FIG. 12). Thus, the support portion 200 is pivotal about axis A1 relative to the frame 100, so that the seat portion 300 is movable in a swinging motion in directions D1, D2 relative to the frame 100 (as shown in FIG. 3).

The seat portion 300 is maintained in its lowered position P7 due to downward gravitational forces created by the seat portion 300 acting upon the hanger arms 202*a*, 202*b*, as well as forces directed outwardly from the rotational axis A1 as the seat portion 300 pivots back and forth in its swinging motion. In one embodiment, the seat portion 300 may additionally be releasably retained in its lowered position P7 via releasably inserting the pins 322 of latch mechanisms 320 in correspondingly configured openings proximate the distal end portions 206*a*, 206*b* of the hanger arms 202*a*, 202*b*, respectively.

In one embodiment, the infant support structure S2 (or support structure S1, S3 or S4) includes a motor (not shown) operatively coupled to at least one of the hanger arms 202*a*, 202*b* for effectuating the swinging motion of the seat portion 300 in back and forth directions D1, D2. The motor may be disposed within or coupled to one of the hubs 136, 140 of the frame 100, and coupled to the end portion 204*a* of the right hanger arm 202*a* (and/or the end portion 204*b* of the left hanger arm 202*b*). A force from the motor is applied to the end portion 204*a* (or end portion 204*b*) to cause the back the forth motion of the hanger arms 202*a*, 202*b* and the seat portion 300.

Figure 16:
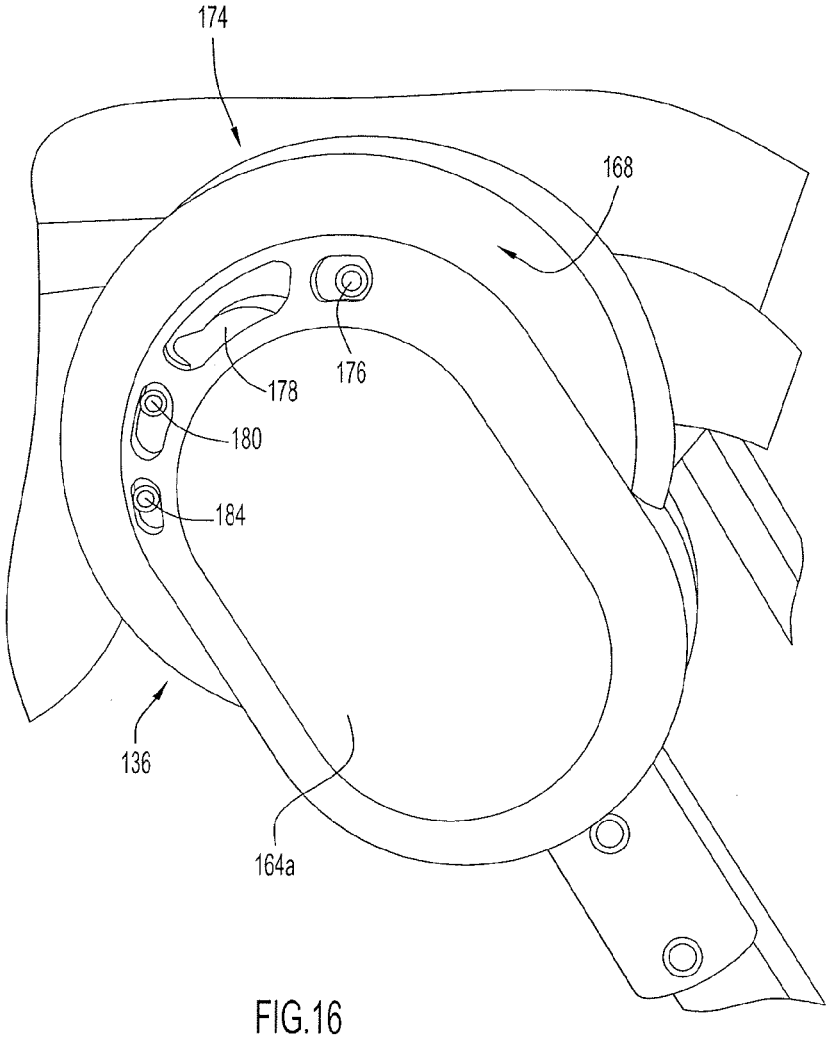
FIG. 16 illustrates a perspective view of a control panel on a hub of the frame of an infant support structure.

Referring to FIG. 16, in one embodiment, a control panel 174 is disposed on the outwardly facing surface 168 of hub 136. The control panel 174 includes an on/off switch 176, which is operatively coupled to a control circuit to activate or deactivate a power source for the motor. The motor is coupled to and powered by the power source, such as batteries disposed within a compartment 164*a* provided within a cavity of the body 164 of the hub 136. In addition or alternatively, the motor may be powered by an associated AC adapter and power cord connected to a power source (e.g. an electrical outlet).

The control panel 174 also includes another switch, such as a rotatable dial 178, for controlling the speed of the swinging motion of the seat portion 300. Dial 178 sends a signal to the control circuit to activate or deactivate the motor. For example, after the power source has been activated via switch 176, the speed of motion of the seat portion 300 may be increased by rotating the dial 178 in a clockwise direction. The maximum speed of motion of the seat portion 300 is attained when the dial 178 has been rotated clockwise to its rightmost position. The speed of motion of the seat portion 300 may be decreased by rotating the dial 178 counterclockwise. The motion of the seat portion 300 may be stopped when the dial 178 has been rotated counterclockwise and to its left most position (such as shown in FIG. 16).

The control panel 174 may include additional switches for controlling additional features of the infant support structure S2 (or support structure S1, S3 or S4). For example, the control panel 174 may include a switch 180 operatively coupled to the control circuit to activate or deactivate an audio output via an operatively associated speaker configured for sound emission. In one embodiment, hub 136 includes a speaker 182 disposed on the inwardly facing surface 166 thereof, as illustrated in FIG. 8. Music, sound effects, or one or more songs may be stored in a memory in communication with the control circuit, which are output in series or randomly upon activation of the switch 180. Referring again to FIG. 16, the control panel 174 may additionally include another switch 184 for controlling the volume level of the audio output when the switch 180 has been activated.

In order to reconfigure the infant support structure S2 (or support structure S1, S3 or S4) from its swing configuration (shown in FIG. 3) to a high chair configuration (shown in FIG. 2), the hanger arms 202*a*, 202*b* are pivoted backwardly in direction D2 until the locking mechanisms 212 are aligned with the upper crossbar 130 (as shown in FIG. 12). Each of the locking mechanisms 212 is then moved from its retracted position P9 to its deployed position P10 (shown in FIG. 13) by pulling downwardly on the lower portion 216 until the base 222 is engaging the upper crossbar 130. At this point, the hanger arms 202*a*, 202*b* are retained in their locked position P6 and the seat portion 300 is in its lowered position P7 (as shown in FIG. 4). In the lowered position P7, the projection 330 on the slide member 312*a* (and/or slide member 312*b*) of the seat portion 300 is still seated within the jacket member 234 of the locking mechanism 212. Thus, the locking mechanism 212 is not yet releasably locked in its deployed position P10 since the release trigger 232 remains depressed by the projection 330.

With the support portion 200 in its locked position P6, the slide members 312*a*, 312*b* may then be slid upwardly along the hanger arms 202*a*, 202*b* so that the seat portion 300 is moved from its lowered position P7 (shown in FIG. 4) to its raised position P8 (shown in FIG. 2). As the seat portion 300 is moved away from its lowered position P7 toward its raised position P8, the projection 330 on the slide member 312*a* (and/or slide member 312*b*) is moved outwardly and away from the jacket member 234 of the locking mechanism 212, as shown in FIGS. 14 and 15. As a result, the projection 330 is disengaged from the release trigger 232, thereby activating the catch of the locking mechanism 212. Thus, the locking mechanism 212 is releasably locked in its deployed position P10, and can not be moved to its retracted position P9 unless and until the release trigger 232 is again engaged (such as by the projection 330 when the seat portion 300 is slid back down to its lowered position P7). The locking mechanism 212 thereby prevents or minimizes the possibility that the hanger arms 202*a*, 202*b* will undesirably move to their released position P5 when the seat portion 300 is in its raised position P8. The locking mechanism 212 maintains the hanger arms 202*a*, 202*b* in their locked position P6 until a user chooses to reconfigure the infant support structure S2 back to its swing mode.

Further, with the support portion 200 in its locked position P6, movement of the seat portion 300 is no longer obstructed by the engagement members 172, 326, as described above. Thus, the seat portion 300 may be moved upwardly along the hanger arms 202*a*, 202*b* to its fully raised position P8, so that the engagement member 172 of the hub 136 is received in the receiving area 328 of the seat portion 300 (as shown in FIGS. 9 and 11). In one embodiment, the user pulls back on the handles 324 of the latch mechanisms 320, thereby releasing the pins 322 from the associated openings in the hanger arms 202*a*, 202*b* proximate the distal end portions 206*a*, 206*b*. After releasing the seat portion 300 from being locked in its lowered position P7 via the latch mechanisms 320, the user may slide the seat portion 300 upwardly along the hanger arms 202*a*, 202*b*, such as by pushing upwardly on the handles 324. Once the seat portion 300 is in its raised position P8, the user may release the handles 324. In turn, the pins 322 are biased inwardly, such as via the springs, and received in correspondingly configured and positioned openings 208 proximate the end portions 204*a*, 204*b* of the hanger arms 202*a*, 202*b*, respectively. Thus, the seat portion 300 is thereby releasably locked in its raised position P8 via the latch mechanisms 320.

In one embodiment, the seat portion 300 is not pivoted by the motor in direction D2 a sufficient distance so that the hanger arms 202*a*, 202*b* are aligned with the upper crossbar 130. Rather, in order to align the hanger arms 202*a*, 202*b* with the upper crossbar 130, a user manually grasps the hanger arms 202*a*, 202*b* and pulls them back in direction D2 with a sufficient amount of force until the associated locking mechanisms 212 are aligned with the crossbar 130.

To reconfigure the infant support structure S2 (or support structure S1, S3 or S4) back to its swing mode configuration, the user pulls outwardly on the handles 324 of the latch mechanisms 320, slides the seat portion 300 downwardly, and releases the locking mechanisms 212, as described above. In this way, the infant support structure S2 (or support structure S1, S3 or S4) is easily reconfigurable between a swing mode in which the seat portion 300 moves in a swinging motion relative to the frame 100, and a highchair mode in which the seat portion 300 is fixed relative to the frame 100.

In one embodiment, the motor for causing the swinging motion is electronically disabled when the seat portion 300 is moved to its raised position P8. For example, the hub 136 (and/or hub 140) may include a switch or sensor that is activated when the engagement member 172 is disposed in the receiving area 328. Upon activation, the switch sends a signal to the control circuit, which causes the motor to be disabled. In one embodiment, the audio output is functional regardless of the position of the seat portion 300 relative to the frame 100. As such, audio output may be provided when the infant support structure S2 (or support structure S1, S3 or S4) is in either its swing mode or its highchair mode.

In one embodiment, the various components of the frame can be metal tubular members and the seat and hubs formed of molded plastic.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A reconfigurable infant support structure, comprising:

a frame configured to be supported by a support surface;

an arm coupled to the frame, the arm being placeable in a locked position in which the arm engages the frame and in a released position in which the arm moves relative to the frame; and a seat portion coupled to the arm and configured to support an infant, the seat portion being movable along the arm between a lowered position and a raised position, the seat portion being movable to its raised position only when the arm is in its locked position.

2. The reconfigurable infant support structure of claim 1, wherein the seat portion is fixed relative to the frame in its raised portion.

3. The reconfigurable infant support structure of claim 1, wherein the frame includes a hub, the arm is coupled to the hub, and movement of the seat portion is obstructed by the hub when the seat portion is moved along the arm toward its raised position when the arm is in its released position.

4. The reconfigurable infant support structure of claim 3, wherein the hub includes an engagement member, the seat portion including a receiving area configured to receive the engagement member when the arm is in its locked position.

5. The reconfigurable infant support structure of claim 1, wherein the seat portion is restricted from being secured in its raised position when the arm is in its released position.

6. The reconfigurable infant support structure of claim 1, wherein the arm is pivotally coupled to the frame so that the seat portion is movable in a swinging motion relative to the frame when the arm is in its released position.

7. The reconfigurable infant support structure of claim 1, wherein the arm includes a first end portion pivotally coupled to the frame and an opposite second end portion, the second end portion including a locking mechanism movable between a latched position engaging a portion of the frame and an unlatched position when the arm is in its released position.

8. The reconfigurable infant support structure of claim 7, wherein the locking mechanism cannot be moved to its unlatched position until the seat portion is moved into its lowered position.

9. A reconfigurable infant support structure, comprising: a frame;

a hanger arm movably coupled to the frame, the hanger arm being placeable in a moving position and in a fixed position; and a seat movably coupled to the hanger arm, the seat being positionable in a lowered position and in a raised position relative to the frame along the hanger arm, the seat releasably securable in its raised position, and the frame restricting the seat from being releasably secured in its raised position unless the hanger arm is in its fixed position.

10. The reconfigurable infant support structure of claim 9, wherein the frame includes a hub to which the hanger arm is movably coupled, the seat includes a receiving area configured to receive the hub, and the hub is receiveable in the receiving area when the hanger arm is in its fixed position.

11. The reconfigurable infant support structure of claim 9, wherein the hanger arm includes a locking mechanism, the locking mechanism being configured to engage a portion of the frame to retain the hanger arm in its fixed position.

12. The reconfigurable infant support structure of claim 11, wherein the locking mechanism cannot be unlocked until the seat is positioned in its lowered position.

13. The reconfigurable infant support structure of claim 9, wherein the hanger arm is pivotally coupled to the frame so that the seat is movable in a swinging motion relative to the frame when the hanger arm is in its moving position.

14. The reconfigurable infant support structure of claim 9, wherein the seat portion includes a latch mechanism confgured to releasably engage a portion of at least one of the frame and the hanger arm for releasably securing the seat in its raised position.

15. An infant support structure, comprising:

a frame portion configured to be placed on a support surface;

a support portion movably coupled to the frame portion, the support portion having a released position and a locked position relative to the frame portion; and a seat portion movably coupled to the support portion, the seat portion having a first position and a second position relative to the support portion, the seat portion being movable to its second position only when the support portion is in its locked position.

16. The infant support structure of claim 15, wherein the seat portion is restricted from being releasably secured in its second position unless the support portion is in its locked position.

17. The infant support structure of claim 15, wherein the support portion includes at least one arm and the seat portion is slidably coupled to the at least one arm.

18. The infant support structure of claim 15, wherein the first position of the seat portion is a lowered position relative to the support surface and the second position of the seat portion is a raised position relative to the support surface.

19. The infant support structure of claim 15, wherein the frame portion includes a pair of hubs, the support portion includes a pair of arms pivotally supported by the hubs, the first position of the seat portion is a swinging position in which the seat portion moves in a swinging motion relative to the frame, and the second position of the seat portion is a highchair position in which the seat portion is fixed relative to the frame.

20. The infant support structure of claim 19, wherein the frame portion cannot be moved to its released position until the seat is in its first position.

21. The infant support structure of claim 19, wherein at least one of the hubs is configured to engage the seat portion and prevent the seat portion from being releasably secured in its second position when the support portion is in its released position.

22. The infant support structure of claim 15, wherein the support portion is pivotal about a first axis relative to the frame so that the seat portion is movable in a swinging motion relative to the frame when the support portion is in its released position.

23. The infant support structure of claim 22, wherein the frame portion includes a lower section configured for engaging the support surface and an upper section, the support portion coupled to the upper section, the lower section pivotal about a second axis relative to the upper section so that the frame portion is reconfigurable between a folded position and an extended position, the second axis substantially parallel to the first axis.

* * * * *

UNITED STATES PATENT AND TRADEMARK OFFICE

CERTIFICATE OF CORRECTION

PATENT NO. : 8,550,556 B2
APPLICATION NO. : 13/038756
DATED : October 8, 2013
INVENTOR(S) : Ronald Asbach It is certified that error appears in the above-identified patent and that said Letters Patent is hereby corrected as shown below:

In the Specification

Column 9, line 48, delete “minor” and replace with -- mirror --.

In the Claims

Column 15, lines 2-3, claim 14, delete “confgured” and replace with -- configured --.

Signed and Sealed this
Twenty-first Day of October, 2014

Michelle K. Lee

Michelle K. Lee
*Deputy Director of the United States Patent and Trademark Office*